US008672098B2

(12) United States Patent
Kashiwakura et al.

(10) Patent No.: US 8,672,098 B2
(45) Date of Patent: Mar. 18, 2014

(54) ELEVATOR SAFETY DEVICE WITH FOREIGN MATTER DETECTION USING A LIGHT BEAM

(75) Inventors: Hiroshi Kashiwakura, Shiga (JP); Keishiro Hirohata, Shiga (JP); Takuya Fujii, Shiga (JP)

(73) Assignee: Fujitec Co., Ltd., Hikone-shi (JP)

( * ) Notice: Subject to any disclaimer, the term of this patent is extended or adjusted under 35 U.S.C. 154(b) by 383 days.

(21) Appl. No.: 13/125,119

(22) PCT Filed: Sep. 18, 2009

(86) PCT No.: PCT/JP2009/066403
§ 371 (c)(1),
(2), (4) Date: Apr. 20, 2011

(87) PCT Pub. No.: WO2010/047202
PCT Pub. Date: Apr. 29, 2010

(65) Prior Publication Data

US 2011/0192684 A1 Aug. 11, 2011

(30) Foreign Application Priority Data

Oct. 20, 2008 (JP) ..... 2008-270201

(51) Int. Cl.
*B66B 13/14* (2006.01)

(52) U.S. Cl.
USPC ..... 187/316; 187/391

(58) Field of Classification Search
USPC ..... 187/247, 313, 316, 317, 391–393; 49/25–28; 318/466–470
See application file for complete search history.

(56) References Cited

U.S. PATENT DOCUMENTS 4,029,176 A * 6/1977 Mills ..... 187/317
(Continued)

FOREIGN PATENT DOCUMENTS

DE 1 099 143 A 2/1961
JP 61-203680 A 9/1986
(Continued)

OTHER PUBLICATIONS

Japanese Office Action dated Apr. 2, 2013, issued in corresponding Japanese Patent Application No. 2010-534758, with English Translation (8 pages).

(Continued)

*Primary Examiner* — Anthony Salata
(74) *Attorney, Agent, or Firm* — Westerman, Hattori, Daniels & Adrian, LLP

(57) ABSTRACT

There is provided an elevator safety device that can prevent a light beam from being looked into. The elevator safety device according to the present invention includes light emitting means for emitting a light beam crossing an entrance; light receiving means for detecting the light beam emitted from the light emitting means; foreign matter detection means for generating a foreign matter detection signal when detection of the light beam by the light receiving means is interrupted; and control means. The control means causes the light emitting means to stop an emission in a fully opened state of car doors, and causes the light emitting means to start the emission at a start of or during a closing operation of the car doors.

22 Claims, 26 Drawing Sheets

(56) References Cited

U.S. PATENT DOCUMENTS

| | | | | |
|---|---|---|---|---|
| 5,149,921 | A * | 9/1992 | Picado | 187/317 |
| 5,493,812 | A * | 2/1996 | Teich | 49/26 |
| 5,587,566 | A * | 12/1996 | Barten et al. | 187/316 |
| 5,698,824 | A * | 12/1997 | Platt | 187/317 |
| 5,821,478 | A * | 10/1998 | Schroder-Brumloop et al. | 187/316 |
| 5,925,858 | A * | 7/1999 | Full et al. | 187/317 |
| 6,167,991 | B1 * | 1/2001 | Full et al. | 187/317 |
| 6,247,558 | B1 * | 6/2001 | Bailey et al. | 187/317 |
| 6,782,660 | B2 * | 8/2004 | Takada et al. | 49/25 |
| 6,945,363 | B2 * | 9/2005 | Angst et al. | 187/317 |
| 8,314,509 | B2 * | 11/2012 | Fitzgibbon | 307/11 |
| 8,376,090 | B2 * | 2/2013 | Kostka | 187/281 |
| 2011/0155511 | A1 * | 6/2011 | Sun et al. | 187/317 |
| 2013/0025236 | A1 * | 1/2013 | Erny et al. | 52/745.15 |

FOREIGN PATENT DOCUMENTS

| | | | |
|---|---|---|---|
| JP | 4-358685 | A | 12/1992 |
| JP | 07-069571 | A | 3/1995 |
| JP | 11-029284 | A | 2/1999 |
| JP | 2000-095464 | A | 4/2000 |
| JP | 2005-008300 | A | 1/2005 |
| JP | 2007-168962 | A | 7/2007 |
| WO | 2007/039929 | A1 | 4/2007 |

OTHER PUBLICATIONS

Extended European Search Report dated Mar. 7, 2013, issued in corresponding European Patent Application No. 09821901.7 (5 pages).

International Search Report of PCT/JP2009/066403, mailing date Dec. 22, 2009.

* cited by examiner

FIG. 9(a)
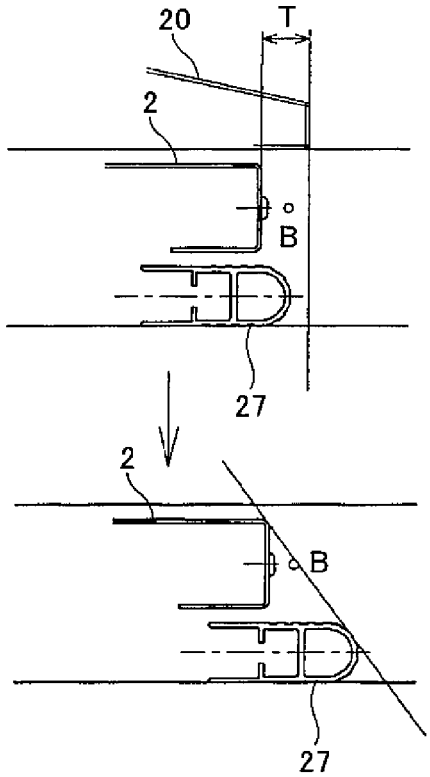
FIG. 9(b)
FIG. 10(a)
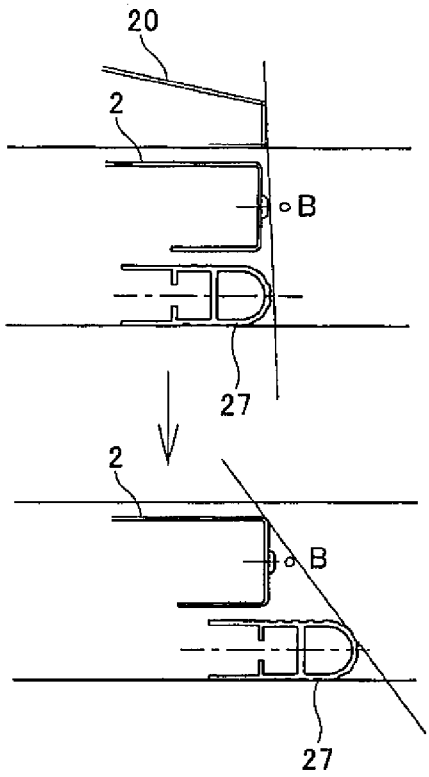
FIG. 10(b)

ELEVATOR SAFETY DEVICE WITH FOREIGN MATTER DETECTION USING A LIGHT BEAM

TECHNICAL FIELD

The present invention relates to an elevator safety device, and more particularly to an elevator safety device that detects a foreign matter at an entrance by using a light beam.

BACKGROUND ART

For an elevator, for example, if a person accompanied by a pet such as a dog on a leash enters an elevator car while the pet is still on a landing floor, a car door and a landing door may close with the leash stretched between the inside of the elevator car and the landing floor, and the elevator car may ascend or descend. Thus, a hand of the person is strongly pulled by the leash on the pet, and in some cases, a wrist or the like may severely be injured.

To a car door of an elevator, a safety shoe frame is mounted, which protrudes from an end surface of the car door in a closing direction and moves relative to the car door. When the safety shoe frame bumps into a person or a foreign matter during closing of the car door and a force is applied to the safety shoe frame, closing operations of the car door and a landing door are inverted to opening operations.

Also, a light beam crossing an entrance of an elevator car is generated, and closing operations of a car door and a landing door are inverted to opening operations when the light beam is blocked by a person or a foreign matter. Various methods are proposed as foreign matter detection methods using a light beam (for example, see Patent Literatures 1 and 2).

CITATION LIST

Patent Literature

Patent Literature 1: Japanese Utility Model Laid-Open No. 61-203680

Patent Literature 2: Japanese Patent Laid-Open No. 4-358685

DISCLOSURE OF THE INVENTION

Some elevators that detect a foreign matter using a light beam adopt a laser as a light emitter.

However, laser lights are classified according to the hazard, and even laser lights in relatively safe classes may cause damage to eyes of a person who looks into the lights. Also, the person may be afraid that his/her eyes are damaged by looking into the lights. Thus, the elevator that detects a foreign matter using a light beam such as a laser light needs to take measures to prevent the light beam from being looked into.

The present invention has an object to provide an elevator safety device that can prevent a light beam from being looked into.

A first elevator safety device according to the present invention is an elevator safety device that includes a pair of car doors that move toward and away from each other to close and open an entrance, including: light emitting means for emitting a light beam crossing the entrance; light receiving means for detecting the light beam emitted from the light emitting means; foreign matter detection means for generating a foreign matter detection signal when detection of the light beam by the light receiving means is interrupted; and control means for controlling opening and closing operations of the car doors and an emission of the light beam by the light emitting means. The control means causes the light emitting means to stop the emission in a fully opened state of the car doors, and causes the light emitting means to start the emission at a start of or during the closing operation of the car doors.

In the first elevator safety device according to the present invention, in the fully opened state of the car doors, the emission by the light emitting means is stopped, and a foreign matter detection operation by the foreign matter detection means is not performed.

At the start of or during the closing operation of the car doors, the emission by the light emitting means is started and the foreign matter detection operation by the foreign matter detection means is started. When there is no foreign matter at the entrance of the elevator car, the light beam emitted from the light emitting means enters the light receiving means after the foreign matter detection operation is started and until the car doors are fully closed. Thus, the detection of the light beam by the light receiving means is not interrupted, and no foreign matter detection signal is generated. In contrast, when there is a foreign matter at the entrance, the light beam emitted from the light emitting means is blocked by the foreign matter after the foreign matter detection operation is started and until the car doors are fully closed. Thus, the detection of the light beam by the light receiving means is interrupted, and thus the foreign matter detection signal is generated.

In the first elevator safety device according to the present invention, as described above, the emission by the light emitting means is stopped in the fully opened state of the car doors, thereby preventing the light beam from being looked into in the state.

In a specific aspect, the control means causes the light emitting means to stop the emission during a normal opening operation in which the car doors open from a fully closed position. This can prevent the light beam from being looked into during the normal opening operation of the car doors.

In a specific aspect, the control means inverts the car doors from the closing operation to the opening operation when the foreign matter detection means generates a foreign matter detection signal during closing of the car doors, and causes the light emitting means to stop the emission during an invert opening operation of the car doors.

In the specific aspect, when there is a foreign matter at the entrance, the foreign matter detection signal is generated during closing of the car doors as described above, and thus the car doors are inverted from the closing operation to the opening operation. At this time, the emission by the light emitting means is stopped. This can prevent the light beam from being looked into during the invert opening operation of the car doors.

If a person tries to place his/her head or shoulder in the entrance to look into the light beam emitted from the light emitting means during the closing operation of the car doors, the foreign matter detection means detects the person's head or shoulder as a foreign matter. Thus, the car doors are inverted from the closing operation to the opening operation, and the emission by the light emitting means is stopped. Thus, it is impossible to look into the light beam emitted from the light emitting means during the closing operation of the car doors, thereby preventing the light beam from being looked into also during the closing operation of the car doors.

A second elevator safety device according to the present invention is an elevator safety device that includes a pair of car doors that move toward and away from each other to close and open an entrance, including: light emitting means for emitting a light beam crossing the entrance; light receiving means for detecting the light beam emitted from the light emitting means; foreign matter detection means for generating a foreign matter detection signal when detection of the light beam by the light receiving means is interrupted; closed position detection means for detecting that the car doors are closed to a predetermined closed position; and control means for controlling opening and closing operations of the car doors and an emission of the light beam by the light emitting means. The control means causes the light emitting means to stop the emission in a fully opened state of the car doors and after a closing operation of the car doors is started and until the closed position detection means detects that the car doors are closed to the predetermined closed position, and causes the light emitting means to start the emission when the closed position detection means detects that the car doors are closed to the predetermined closed position.

In the second elevator safety device according to the present invention, in the fully opened state of the car doors and after the closing operation of the car doors is started and until a closed position of the car doors reaches the predetermined closed position, the emission by the light emitting means is stopped, and the foreign matter detection operation by the foreign matter detection means is not performed. The predetermined closed position is set in a position where a width between end surfaces in a closing direction of the car doors to abut against each other is such a width that a person's head or shoulder cannot enter between the end surfaces.

At the time when the closed position of the car doors reaches the predetermined closed position, the emission by the light emitting means is started, and the foreign matter detection operation by the foreign matter detection means is started. When there is no foreign matter at the entrance of the elevator car, the light beam emitted from the light emitting means enters the light receiving means after the foreign matter detection operation is started and until the car doors are fully closed. Thus, the detection of the light beam by the light receiving means is not interrupted, and no foreign matter detection signal is generated. In contrast, when there is a foreign matter at the entrance, the light beam emitted from the light emitting means is blocked by the foreign matter after the foreign matter detection operation is started and until the car doors are fully closed. Thus, the detection of the light beam by the light receiving means is interrupted, and the foreign matter detection signal is generated.

In the second elevator safety device according to the present invention, as described above, in the fully opened state of the car doors, the emission by the light emitting means is stopped, thereby preventing the light beam from being looked into in the state. Also, during the closing operation of the car doors, the emission by the light emitting means is started at the time when the car doors are closed to the predetermined closed position. Thus, it is physically impossible for a person to place his/her head or shoulder in the entrance to look into the light beam after the emission is started, thereby reliably preventing the light beam from being looked into also during the closing operation of the car doors.

In a specific aspect, the control means causes the light emitting means to stop the emission during a normal opening operation in which the car doors open from the fully closed position. This can prevent the light beam from being looked into during the normal opening operation of the car doors.

In a specific aspect, the control means inverts the car doors from the closing operation to the opening operation when the foreign matter detection means generates a foreign matter detection signal during closing of the car doors, and causes the light emitting means to stop the emission during a invert opening operation of the car doors.

In a specific aspect, when there is a foreign matter at the entrance, as described above, the foreign matter detection signal is generated during closing of the car doors from the predetermined closed position, and thus the car doors are inverted from the closing operation to the opening operation. At this time, the emission by the light emitting means is stopped. This can prevent the light beam from being looked into during the invert opening operation of the car doors.

A third elevator safety device according to the present invention is an elevator safety device that includes a pair of car doors that move toward and away from each other to close and open an entrance, including: light emitting means for emitting a light beam crossing the entrance; light receiving means for detecting the light beam emitted from the light emitting means; foreign matter detection means for generating a foreign matter detection signal when detection of the light beam by the light receiving means is interrupted; and control means for controlling opening and closing operations of the car doors and an emission of the light beam by the light emitting means. The control means causes the light emitting means to perform the emission in a fully opened state of the car doors, and causes the light emitting means to stop the emission when the foreign matter detection means generates a foreign matter detection signal in the state.

In the third elevator safety device according to the present invention, in the fully opened state of the car doors, the emission by the light emitting means is performed and the foreign matter detection operation by the foreign matter detection means is performed. When there is no foreign matter at the entrance of the elevator car, the light beam emitted from the light emitting means enters the light receiving means. Thus, the detection of the light beam by the light receiving means is not interrupted, and no foreign matter detection signal is generated. In contrast, when there is a foreign matter at the entrance, the light beam emitted from the light emitting means is blocked by the foreign matter, and thus the detection of the light beam by the light receiving means is interrupted, and the foreign matter detection signal is generated.

In the third elevator safety device according to the present invention, as described above, when a foreign matter detection signal is generated in the fully opened state of the car doors, the emission by the light emitting means is stopped. Thus, if a person tries to place his/her head or shoulder in the entrance to look into the light beam emitted from the light emitting means in the fully opened state of the car doors, the person's head or shoulder is detected as a foreign matter, and thus the emission by the light emitting means is stopped. Thus, it is impossible to look into the light beam emitted from the light emitting means in the fully opened state of the car doors, thereby preventing the light beam from being looked into in the fully opened state of the car doors.

In a specific aspect, the control means extends a time period during which the car doors should be maintained in the fully opened state when the foreign matter detection means generates a foreign matter detection signal in the fully opened state of the car doors. Thus, if a person tries to place his/her head or shoulder in the entrance to look into the light beam immediately before the closing operation of the car doors is started, the car door can be prevented from bumping into the person's head or shoulder.

In a specific aspect, the control means causes the light emitting means to stop the emission in the fully opened state of the car doors, then causes the light emitting means to start the emission at the expiration of the time period during which the car doors should be maintained in the fully opened state, and causes the light emitting means to stop the emission and extends the time period during which the car doors should be maintained in the fully opened state when the foreign matter detection means generates a foreign matter detection signal, while the control means starts the closing operation of the car doors when no foreign matter detection signal is generated.

In the specific aspect, when there is a foreign matter at the entrance in the fully opened state of the car doors or a person is looking into the light beam, and thus the foreign matter detection signal is generated to stop the emission by the light emitting means, the emission by the light emitting means is then started at the expiration of the time period during which the car doors should be maintained in the fully opened state. When a foreign matter detection signal is generated again, it is supposed that the foreign matter remains at the entrance or a person continues looking into the light beam. Thus, the emission by the light emitting means is stopped again, and the car doors are maintained in the fully opened state. In contrast, when no foreign matter detection signal is generated, the closing operation of the car doors is started while the emission by the light emitting means is continued.

Further, in a specific aspect, the control means causes the light emitting means to stop the emission during a normal opening operation in which the car doors open from the fully closed position. This can prevent the light beam from being looked into during the normal opening operation of the car doors.

Further, in a specific aspect, the control means causes the light emitting means to perform the emission during the closing operation of the car doors, inverts the car doors from the closing operation to the opening operation when the foreign matter detection means generates a foreign matter detection signal during closing of the car doors, and causes the light emitting means to stop the emission during an invert opening operation of the car doors.

In the specific aspect, when there is no foreign matter at the entrance of the elevator car, the light beam emitted from the light emitting means enters the light receiving means before the car doors are fully closed. Thus, the detection of the light beam by the light receiving means is not interrupted, and no foreign matter detection signal is generated. In contrast, when there is a foreign matter at the entrance, the light beam emitted from the light emitting means is blocked by the foreign matter before the car doors are fully closed. Thus, the detection of the light beam by the light receiving means is interrupted, and the foreign matter detection signal is generated.

In the specific aspect, when there is a foreign matter at the entrance, the foreign matter detection signal is generated during closing of the car doors as described above, and thus the car doors are inverted from the closing operation to the opening operation. At this time, the emission by the light emitting means is stopped. This can prevent the light beam from being looked into during an invert opening operation of the car doors.

If a person tries to place his/her head or shoulder in the entrance to look into the light beam emitted from the light emitting means during the closing operation of the car doors, the foreign matter detection means detects the person's head or shoulder as a foreign matter. Thus, the car doors are inverted from the closing operation to the opening operation, and the emission by the light emitting means is stopped. Thus, it is impossible to look into the light beam emitted from the light emitting means during the closing operation of the car doors, thereby preventing the light beam from being looked into during the closing operation of the car doors.

In a specific aspect of the first to third elevator safety devices according to the present invention, the control means includes: forcible door closing means for performing a forcible door closing operation of forcibly closing the car doors irrespective of whether or not the foreign matter detection means generates a foreign matter detection signal; and notification means for notifying of performance of the forcible door closing operation before or during the forcible door closing operation by the forcible door closing means.

According to the specific aspect, an accident can be prevented that a passenger is caught by the car door at completion of the forcible door closing operation.

In a specific aspect, the control means further includes: elevator car control means for starting traveling of the elevator car after the forcible door closing means completes the forcible door closing operation; and second notification means for notifying of starting traveling of the elevator car before the elevator car control means starts traveling of the elevator car when the foreign matter detection means generates a foreign matter detection signal during the forcible door closing operation by the forcible door closing means.

According to the specific aspect, if a person mischievously or intentionally stretches a foreign matter (for example, a string-like foreign matter) between the elevator car and a landing floor, an accident can be prevented that traveling of the elevator car is started with the foreign matter caught between the car door and the landing door after the forcible door closing operation is completed.

A fourth elevator safety device according to the present invention is an elevator safety device that includes at least one car door that moves toward and away from a doorstop frame to close and open an entrance, including: light emitting means for emitting a light beam crossing the entrance; light receiving means for detecting the light beam emitted from the light emitting means; foreign matter detection means for generating a foreign matter detection signal when detection of the light beam by the light receiving means is interrupted; and control means for controlling opening and closing operations of the car door and an emission of the light beam by the light emitting means. The control means causes the light emitting means to stop the emission in a fully opened state of the car door, and causes the light emitting means to start the emission at a start or during the closing operation of the car door.

In the fourth elevator safety device according to the present invention, in the fully opened state of the car door, the emission by the light emitting means is stopped, and the foreign matter detection operation by the foreign matter detection means is not performed.

The emission by the light emitting means is started at the start or during the closing operation of the car door, and the foreign matter detection operation by the foreign matter detection means is started. When there is no foreign matter at the entrance of the elevator car, the light beam emitted from the light emitting means enters the light receiving means after the foreign matter detection operation is started and until the car door is fully closed. Thus, the detection of the light beam by the light receiving means is not interrupted, and no foreign matter detection signal is generated. In contrast, when there is a foreign matter at the entrance, the light beam emitted from the light emitting means is blocked by the foreign matter after the foreign matter detection operation is started and until the car door is fully closed. Thus, the detection of the light beam by the light receiving means is interrupted, and the foreign matter detection signal is generated.

In the fourth elevator safety device according to the present invention, as described above, the emission by the light emitting means is stopped in the fully opened state of the car door, thereby preventing the light beam from being looked into in the state.

In a specific aspect, the control means causes the light emitting means to stop the emission during a normal opening operation in which the car door opens from the fully closed position. This can prevent the light beam from being looked into during the normal opening operation of the car door.

In a specific aspect, the control means inverts the car door from the closing operation to the opening operation when the foreign matter detection means generates a foreign matter detection signal during closing of the car door, and causes the light emitting means to stop the emission during a invert opening operation of the car door.

In the specific aspect, when there is a foreign matter at the entrance, as described above, the foreign matter detection signal is generated during the closing of the car door, and thus the car door is inverted from the closing operation to the opening operation. At this time, the emission by the light emitting means is stopped. This can prevent the light beam from being looked into during the invert opening operation of the car door.

If a person tries to place his/her head or shoulder in the entrance to look into the light beam emitted from the light emitting means during the closing operation of the car door, the foreign matter detection means detects the person's head or shoulder as a foreign matter. Thus, the car door is inverted from the closing operation to the opening operation, and the emission by the light emitting means is stopped. Thus, it is impossible to look into the light beam emitted from the light emitting means during the closing operation of the car door, thereby preventing the light beam from being looked into during the closing operation of the car door.

A fifth elevator safety device according to the present invention is an elevator safety device that includes at least one car door that moves toward and away from a doorstop frame to close and open an entrance, including: light emitting means for emitting a light beam crossing the entrance; light receiving means for detecting the light beam emitted from the light emitting means; foreign matter detection means for generating a foreign matter detection signal when detection of the light beam by the light receiving means is interrupted; closed position detection means for detecting that the car door is closed to a predetermined closed position; and control means for controlling opening and closing operations of the car door and an emission of the light beam by the light emitting means. The control means causes the light emitting means to stop an emission in a fully opened state of the car door and after the closing operation of the car door is started and until the closed position detection means detects that the car door is closed to the predetermined closed position, and causes the light emitting means to start the emission when the closed position detection means detects that the car door is closed to the predetermined closed position.

In the fifth elevator safety device according to the present invention, in the fully opened state of the car door and after the closing operation of the car door is started and until a closed position of the car door reaches the predetermined closed position, the emission by the light emitting means is stopped, and the foreign matter detection operation by the foreign matter detection means is not performed. The predetermined closed position is set in a position where a width between an end surface in a closing direction of the car door and the doorstop frame is such a width that a person's head or shoulder cannot enter between the end surface and the doorstop frame.

At the time when the closed position of the car door reaches the predetermined closed position, the emission by the light emitting means is started, and the foreign matter detection operation by the foreign matter detection means is started. When there is no foreign matter at the entrance of the elevator car, the light beam emitted from the light emitting means enters the light receiving means after the foreign matter detection operation is started and until the car door is fully closed. Thus, the detection of the light beam by the light receiving means is not interrupted, and no foreign matter detection signal is generated. In contrast, when there is a foreign matter at the entrance, the light beam emitted from the light emitting means is blocked by the foreign matter after the foreign matter detection operation is started and until the car door is fully closed. Thus, the detection of the light beam by the light receiving means is interrupted, and the foreign matter detection signal is generated.

In the fifth elevator safety device according to the present invention, as described above, the emission by the light emitting means is stopped in the fully opened state of the car door, thereby preventing the light beam from being looked into in the state. Also, during the closing operation of the car door, the emission by the light emitting means is started at the time when the car door is closed to the predetermined closed position. Thus, it is physically impossible for a person to place his/her head or shoulder in the entrance to look into the light beam after the emission is started, thereby reliably preventing the light beam from being looked into during the closing operation of the car doors.

In a specific aspect, the control means causes the light emitting means to stop the emission during a normal opening operation in which the car door opens from the fully closed position. This can prevent the light beam from being looked into during the normal opening operation of the car door.

In a specific aspect, the control means inverts the car door from the closing operation to the opening operation when the foreign matter detection means generates a foreign matter detection signal during closing of the car door, and causes the light emitting means to stop the emission during the invert opening operation of the car door.

In the specific aspect, when there is a foreign matter at the entrance, as described above, the foreign matter detection signal is generated during the closing of the car door from the predetermined closed position, and thus the car door is inverted from the closing operation to the opening operation. At this time, the emission by the light emitting means is stopped. This can prevent the light beam from being looked into during the invert opening operation of the car door.

A sixth elevator safety device according to the present invention is an elevator safety device that includes at least one car door that moves toward and away from a doorstop frame to close and open an entrance, including: light emitting means for emitting a light beam crossing the entrance; light receiving means for detecting the light beam emitted from the light emitting means; foreign matter detection means for generating a foreign matter detection signal when detection of the light beam by the light receiving means is interrupted; and control means for controlling opening and closing operations of the car door and an emission of the light beam by the light emitting means. The control means causes the light emitting means to perform the emission in a fully opened state of the car door, and causes the light emitting means to stop the emission when the foreign matter detection means generates a foreign matter detection signal in the state.

In the sixth elevator safety device according to the present invention, in the fully opened state of the car door, the emission by the light emitting means is performed, and the foreign matter detection operation by the foreign matter detection means is performed. When there is no foreign matter at the entrance of the elevator car, the light beam emitted from the light emitting means enters the light receiving means. Thus, the detection of the light beam by the light receiving means is not interrupted, and no foreign matter detection signal is generated. In contrast, when there is a foreign matter at the entrance, the light beam emitted from the light emitting means is blocked by the foreign matter, and thus the detection of the light beam by the light receiving means is interrupted, and the foreign matter detection signal is generated.

In the sixth elevator safety device according to the present invention, as described above, when a foreign matter detection signal is generated in the fully opened state of the car door, the emission by the light emitting means is stopped. Thus, if a person tries to place his/her head or shoulder in the entrance to look into the light beam emitted from the light emitting means in the fully opened state of the car door, the person's head or shoulder is detected as a foreign matter, and thus the emission by the light emitting means is stopped. Thus, it is impossible to look into the light beam emitted from the light emitting means in the fully opened state of the car door, thereby preventing the light beam from being looked into in the fully opened state of the car door.

In a specific aspect, the control means extends a time period during which the car door should be maintained in the fully opened state when the foreign matter detection means generates a foreign matter detection signal in the fully opened state of the car door. Thus, if a person tries to place his/her head or shoulder in the entrance to look into the light beam immediately before the closing operation of the car door is started, the car door can be prevented from bumping into the person's head or shoulder.

In a specific aspect, the control means causes the light emitting means to stop the emission in the fully opened state of the car door, then causes the light emitting means to start the emission at the expiration of the time period during which the car door should be maintained in the fully opened state, and causes the light emitting means to stop the emission and extends the time period during which the car door should be maintained in the fully opened state when the foreign matter detection means generates a foreign matter detection signal, while the control means starts the closing operation of the car door when no foreign matter detection signal is generated.

In the specific aspect, when there is a foreign matter at the entrance in the fully opened state of the car door or a person is looking into the light beam, and thus the foreign matter detection signal is generated to stop the emission by the light emitting means, the emission by the light emitting means is then started at the expiration of the time period during which the car door should be maintained in the fully opened state. When a foreign matter detection signal is generated again, it is supposed that a foreign matter remains at the entrance or a person continues looking into the light beam. Thus, the emission by the light emitting means is stopped again, and the car door is maintained in the fully opened state. In contrast, when no foreign matter detection signal is generated, the closing operation of the car door is started while the emission by the light emitting means is continued.

Further, in a specific aspect, the control means causes the light emitting means to stop the emission during a normal opening operation in which the car door opens from the fully closed position. This can prevent the light beam from being looked into during the normal opening operation of the car door.

Further, in a specific aspect, the control means causes the light emitting means to perform the emission during the closing operation of the car door, inverts the car door from the closing operation to the opening operation when the foreign matter detection means generates a foreign matter detection signal during closing of the car door, and causes the light emitting means to stop the emission during a invert opening operation of the car door.

In the specific aspect, when there is no foreign matter at the entrance of the elevator car, the light beam emitted from the light emitting means enters the light receiving means before the car door is fully closed. Thus, the detection of the light beam by the light receiving means is not interrupted, and no foreign matter detection signal is generated. In contrast, when there is a foreign matter at the entrance, the light beam emitted from the light emitting means is blocked by the foreign matter before the car door is fully closed. Thus, the detection of the light beam by the light receiving means is interrupted, and the foreign matter detection signal is generated.

In the specific aspect, when there is a foreign matter at the entrance, the foreign matter detection signal is generated during closing of the car door as described above, and thus the car door is inverted from the closing operation to the opening operation. At this time, the emission by the light emitting means is stopped. This can prevent the light beam from being looked into during an invert opening operation of the car door.

If a person tries to place his/her head or shoulder in the entrance to look into the light beam emitted from the light emitting means during the closing operation of the car door, the foreign matter detection means detects the person's head or shoulder as a foreign matter. Thus, the car door is inverted from the closing operation to the opening operation, and the emission by the light emitting means is stopped. Thus, it is impossible to look into the light beam emitted from the light emitting means during the closing operation of the car door, thereby preventing the light beam from being looked into during the closing operation of the car door.

In a specific aspect of the fourth to sixth elevator safety device according to the present invention, the control means further includes: forcible door closing means for performing a forcible door closing operation of forcibly closing the car door irrespective of whether or not the foreign matter detection means generates a foreign matter detection signal; and notification means for notifying of performance of the forcible door closing operation before or during the forcible door closing operation by the forcible door closing means.

According to the specific aspect, an accident can be prevented that a passenger is caught by the car door at completion of the forcible door closing operation.

In a specific aspect, the control means further includes: elevator car control means for starting traveling of the elevator car after the forcible door closing means completes the forcible door closing operation; and second notification means for notifying of starting traveling of the elevator car before the elevator car control means starts traveling of the elevator car when the foreign matter detection means generates a foreign matter detection signal during the forcible door closing operation by the forcible door closing means.

According to the specific aspect, if a person mischievously or intentionally stretches a foreign matter (for example, a string-like foreign matter) between the elevator car and a landing floor, an accident can be prevented that traveling of the elevator car is started with the foreign matter caught between the car door and the landing door after the forcible door closing operation is completed.

The first to sixth elevator safety devices according to the present invention can prevent the light beam from being looked into.

BRIEF DESCRIPTION OF THE DRAWINGS

FIG. 9(*a*) and FIG. 9(*b*) are horizontal sectional views showing an arrangement example of a light beam with an overtravel;

FIG. 10(*a*) and FIG. 10(*b*) are horizontal sectional views showing an arrangement example of a light beam without an overtravel;

BEST MODE FOR CARRYING OUT THE INVENTION

Now, embodiments of the present invention will be described in detail with reference to the drawings.

First Embodiment

Figure 1:
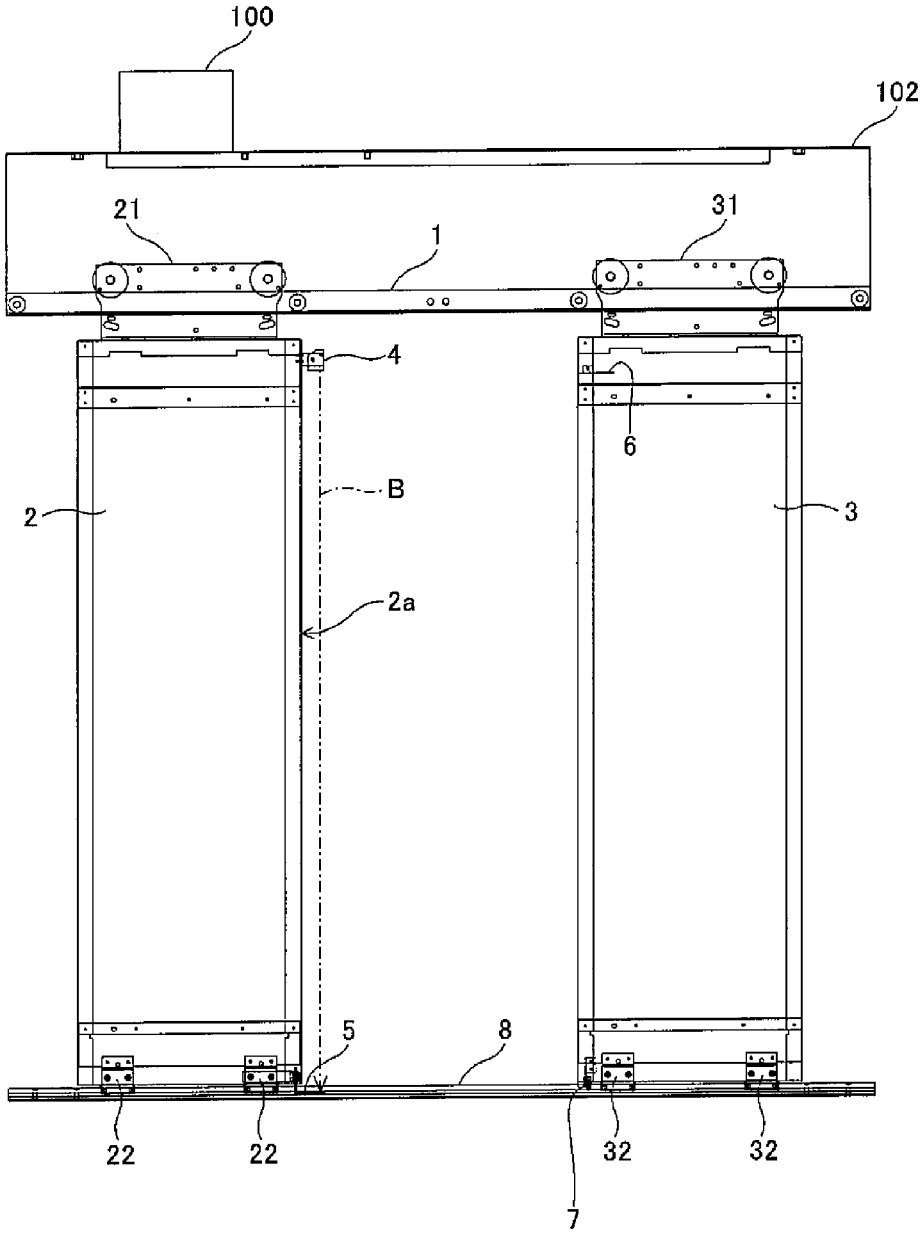
FIG. 1 is a front view showing a fully opened state of car doors of an elevator according to the present invention.
Figure 2:
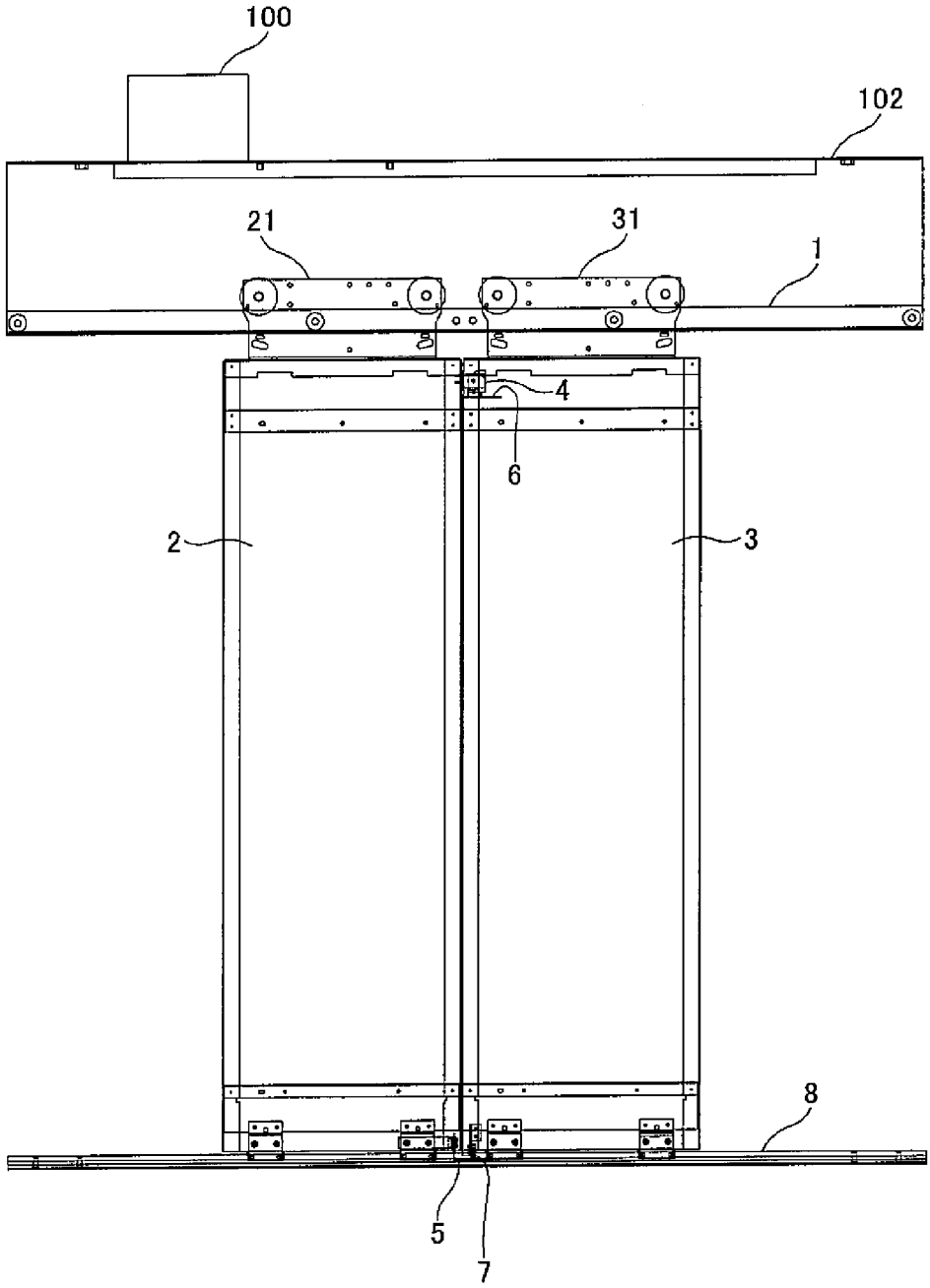
FIG. 2 is a front view showing a fully closed state of the car doors of the elevator.

As shown in FIGS. 1 and 2, an elevator according to this embodiment is a center open type elevator including a pair of left and right car doors (2) and (3) that open and close an entrance of an elevator car. A rail (1) is secured to a frame (102) in an upper position of the entrance, the car doors (2) and (3) are hung on the rail (1) by hangers (21) and (31), and guide shoes (22) and (32) protruding at lower ends of the doors slidably fit in a doorsill (8) and guide horizontal reciprocation.

On the frame (102), a control unit (100) that controls opening and closing operations of the car doors (2) and (3) is provided.

In the left car door (2), as shown in FIG. 1, a light emitting/receiving unit (4) is provided so as to be directed vertically downward in an upper end position on a vertical line a predetermined distance (for example, 12 mm) apart from an end surface (2*a*) in a closing direction to abut against the right car door (3) toward the right car door (3), while a first reflecting member (5) is provided so as to be directed vertically upward in a lower end position of the vertical line.

Figure 3:
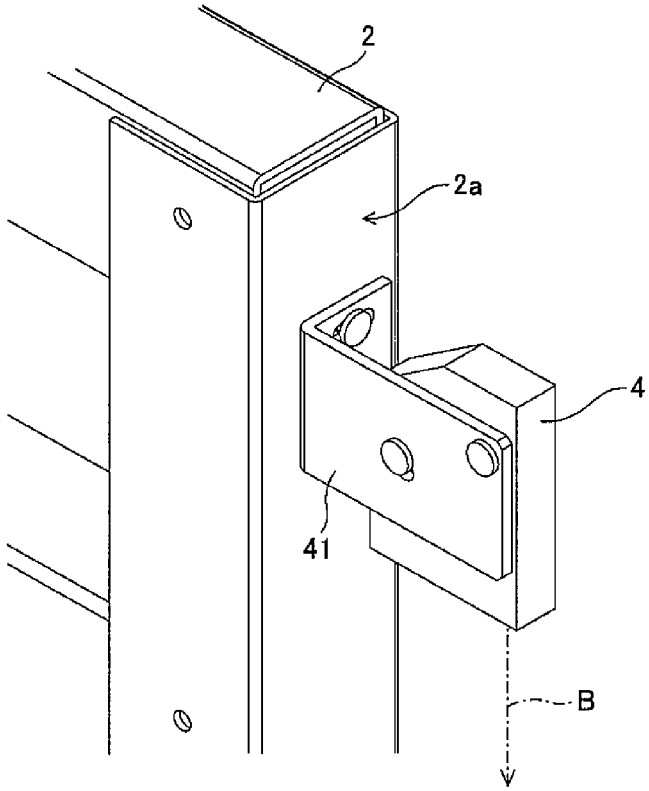
FIG. 3 is a perspective view showing a mounting state of a light emitting/receiving unit in the elevator.

The light emitting/receiving unit (4) integrally includes a light emitter that emits a laser light beam (hereinafter referred to as a light beam) B and a light receiver that detects the incident light beam B, and is supported by a stay (41) secured to the end surface (2*a*) in a closing direction of the car door (2) as shown in FIG. 3. A light beam emission by the light emitting/receiving unit (4) is controlled by the control unit (100).

As the light emitter of the light emitting/receiving unit (4), for example, a red semiconductor laser is adopted, which is used to form a spot having a diameter of 1 to 2 mm. The light receiver of the light emitting/receiving unit (4) does not output a foreign matter detection signal when a light receiving amount by the incident light beam is higher than a predetermined threshold. In contrast, when the light receiving amount by the incident light beam is lower than the predetermined threshold, the light receiver outputs a foreign matter detection signal.

Figure 4:
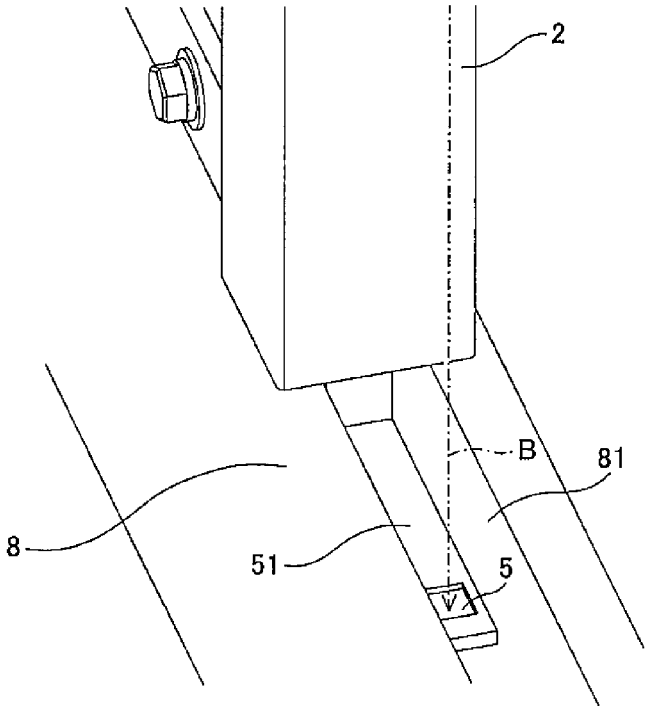
FIG. 4 is a perspective view showing a mounting state of a first reflecting member in the elevator.

As shown in FIG. 4, the first reflecting member (5) is provided in a horizontal arm portion of an L-shaped arm member (51) protruding on a lower end surface of the left car door (2), and has a reflecting surface that reflects the light beam B vertically upward. The arm member (51) is reciprocatably housed in a groove (81) in the doorsill (8) in which the guide shoe of the car door (2) fits.

Figure 8:
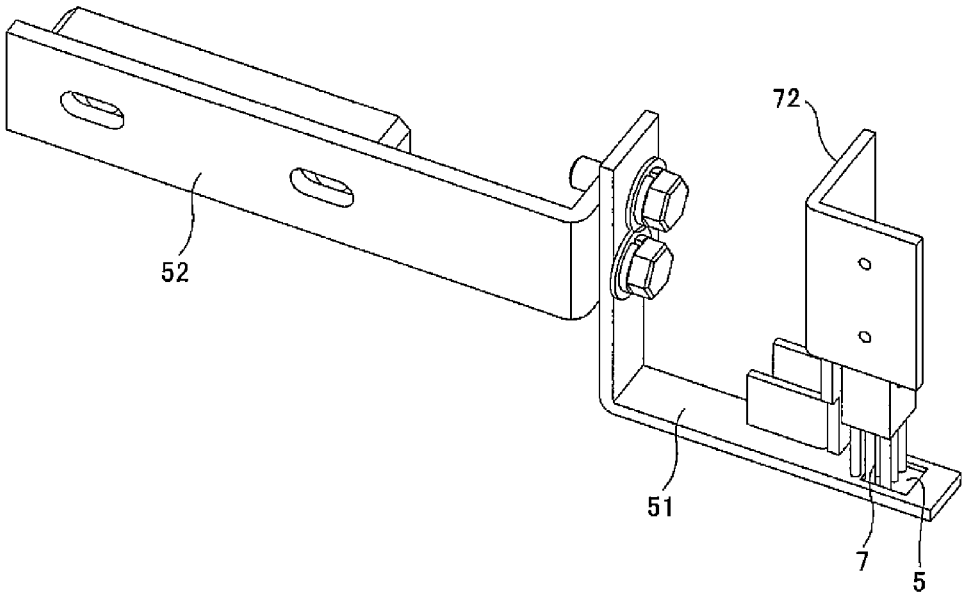
FIG. 8 is a perspective view showing a positional relationship between the first reflecting member and the cleaning tool in the elevator.

The arm member (51) is supported by the left car door (2) via a stay (52) shown in FIG. 8. The stay (52) is mounted to the car door (2) so that a position in a door opening/closing direction can be adjusted, and the arm member (51) is mounted to the stay (52) so that a position in a fore/aft direction perpendicular to the door opening/closing direction can be adjusted.

Figure 5:
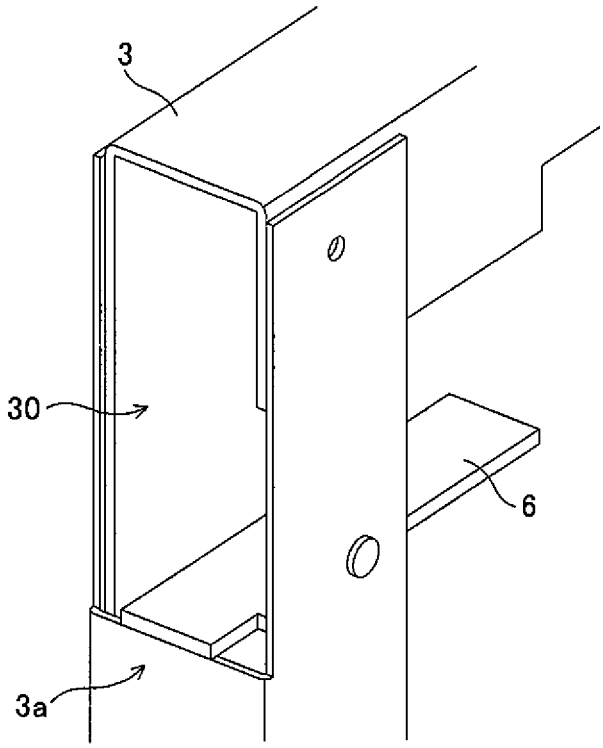
FIG. 5 is a perspective view showing a mounting state of a second reflecting member in the elevator.

As shown in FIG. 5, in an upper end of the right car door (3), a housing space (30) is formed that houses the light emitting/receiving unit with the car doors closed, and a second reflecting member (6) is provided at a bottom of the housing space (30) so as to be directed vertically upward. The second reflecting member (6) has a reflecting surface extending from the same position as an end surface (3*a*) in a closing direction of the right car door (3) toward a back of the housing space (30) and having a predetermined length (for example, 8 mm), and reflects a light beam from the light emitting/receiving unit entering the housing space (30) vertically upward.

Figure 6:
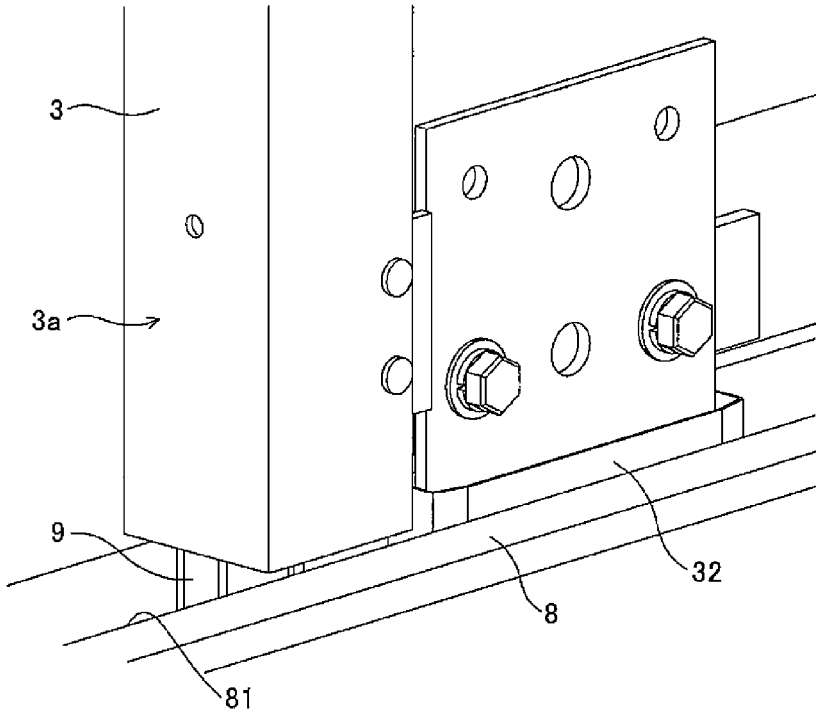
FIG. 6 is a perspective view showing a mounting state of a foreign matter entrance preventing member in the elevator.

As shown in FIG. 6, at a lower end of the right car door (3), a foreign matter entrance preventing member (9) protrudes downward that fills a gap formed between the end surface (3*a*) in a closing direction of the car door (3) and a surface of the doorsill (8). A lower end of the foreign matter entrance preventing member (9) is reciprocatably housed in the groove (81) in the doorsill (8).

Figure 7:
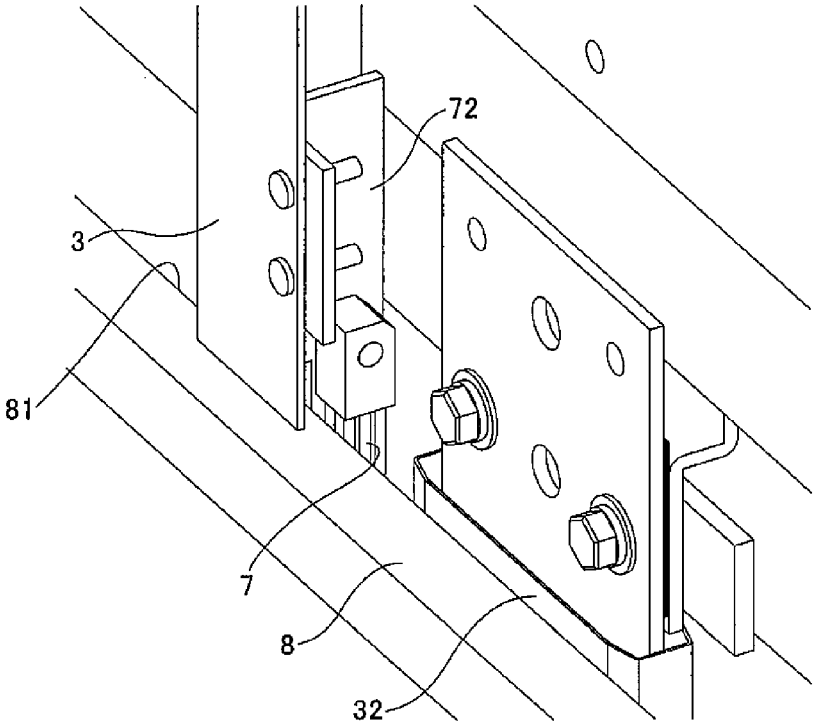
FIG. 7 is a perspective view showing a mounting state of a cleaning tool in the elevator.

Further, at the lower end of the right car door (3), a bracket (72) is secured to a rear position of the foreign matter entrance preventing member (9) as shown in FIG. 7, and the bracket (72) supports a cleaning tool (7) comprising by a brush in the downward.

As shown in FIG. 2, during closing of the car doors (2) and (3) to a fully closed position, the cleaning tool (7) cleans a surface of the first reflecting member (5) provided in the left car door (2) (see FIG. 8). Thus, the surface of the first reflecting member (5) is always maintained as a satisfactory reflecting surface.

A mounting state in which the light emitting/receiving unit (4) is directed vertically downward, and the first reflecting member (5) and the second reflecting member (6) are directed vertically upward includes a mounting state having a slight inclination with respect to the vertical line depending on the configuration of the light emitting/receiving unit (4) (arrangement or the like of the light emitter and the light receiver) or variations in installation position of the car door.

FIG. 9 shows an arrangement example of the light beam B when there is a retraction distance, i.e. an overtravel T, of the end surface in a closing direction in a fully opened position of the car door (2) with reference to an end surface of an entrance column (20) that constitutes the entrance of the elevator car. The light beam B is arranged so that during standby in a door opening state shown in FIG. 9(*a*), the light beam B is positioned outside a width of the entrance, and during closing of the door shown in FIG. 9(*b*), the light beam B is positioned inside a line connecting an edge of the car door (2) and an edge of a safety shoe frame (27).

FIG. 10 shows an arrangement example of the light beam B without an overtravel. The light beam B is arranged so that during standby in a door opening state shown in FIG. 10(*a*), the light beam B is positioned outside the line connecting the edge of the car door (2) and the edge of the safety shoe frame (27), and during closing of the door shown in FIG. 10(*b*), the light beam B is positioned inside the line connecting the edge of the car door (2) and the edge of the safety shoe frame (27).

In the elevator of this embodiment, during standby of the car doors (2) and (3) in the door opening state and during a normal door opening operation of the car doors (2) and (3) from the fully closed position, an emission of the light beam by the light emitting/receiving unit (4) is stopped and a foreign matter detection operation is not performed. At a start of a door closing operation in the fully opened state of the car doors (2) and (3), the emission of the light beam by the light emitting/receiving unit (4) is started and the foreign matter detection operation is started.

During closing of the car doors (2) and (3) from the fully opened state to an almost-fully closed state, the light beam B emitted from the light emitting/receiving unit (4) enters the first reflecting member (5) and is reflected and returns to the light emitting/receiving unit (4) unless there is a foreign matter in a path.

Then, during closing of the car doors (2) and (3) from the almost-fully closed state to the fully closed state, the light emitting/receiving unit (4) enters the housing space (30) formed in the right car door (3). Thus, the light beam B emitted from the light emitting/receiving unit (4) enters the second reflecting member (6) and is reflected and returns to the light emitting/receiving unit (4).

Specifically, during closing of the car doors (2) and (3) from the fully opened state to the fully closed state, the light beam B emitted from the light emitting/receiving unit (4) is reflected by the first reflecting member (5) or the second reflecting member (6) and returns to the light emitting/receiving unit (4) unless there is a foreign matter in the path.

When the light beam is detected, the light emitting/receiving unit (4) does not generate a foreign matter detection signal. The control unit (100) continues the closing operation of the car doors (2) and (3) unless the light emitting/receiving unit (4) generates a foreign matter detection signal during closing of the car doors (2) and (3) from the fully opened state to the fully closed.

In contrast, when the detection of the light beam is interrupted, the light emitting/receiving unit (4) generates and outputs a foreign matter detection signal to the control unit (100). In response thereto, the control unit (100) inverts the car doors (2) and (3) from the closing operation to the opening operation, and causes the light emitting/receiving unit (4) to stop the emission of the light beam.

As described above, when the safety shoe frame bumps into a person or a foreign matter and a force is applied to the safety shoe frame during closing of the car doors (2) and (3) from the fully opened state, the control unit (100) inverts the car doors (2) and (3) from the closing operation to the opening operation, and causes the light emitting/receiving unit (4) to stop the emission of the light beam.

Figure 11A:
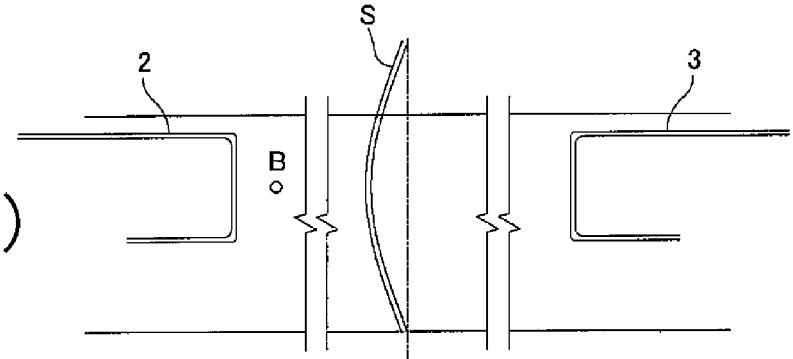
FIGS. 11(*a*)-11(*c*) are series of horizontal sectional views showing a former half of an example of a string detection operation.
Figure 11B:
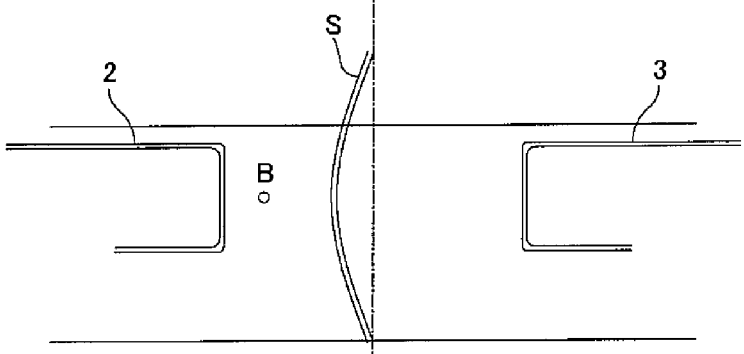
Figure 11C:
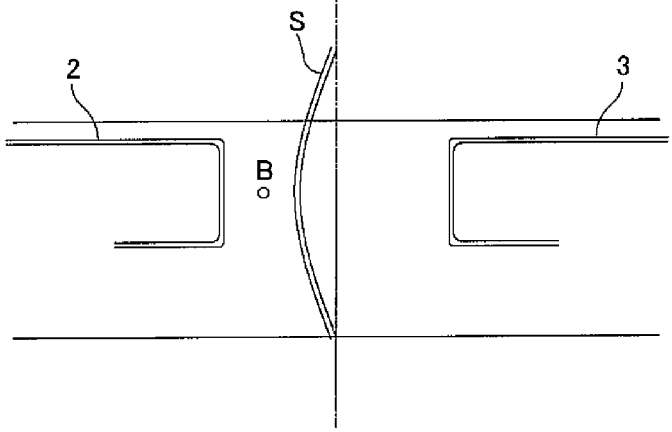
Figure 12A:
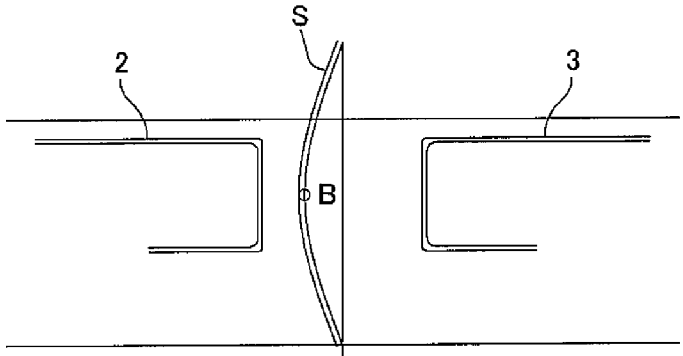
FIGS. 12(*a*)-12(*c*) are series of horizontal sectional views showing a latter half of the example of the string detection operation.
Figure 12B:
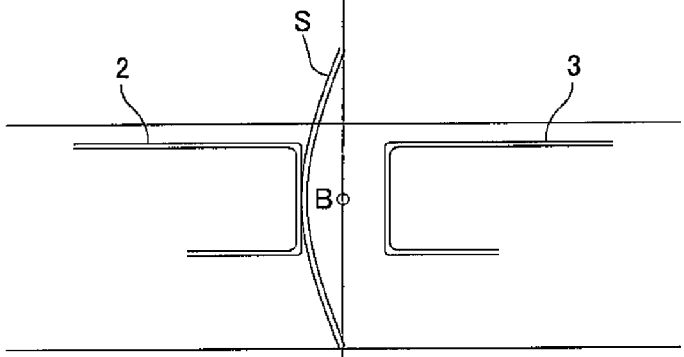
Figure 12C:
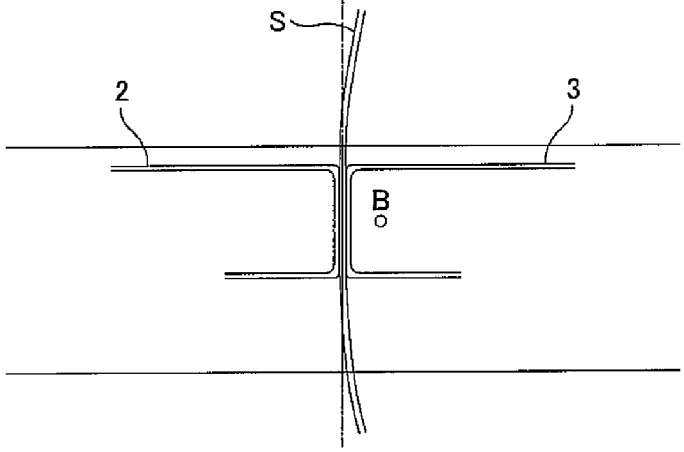

FIGS. 11 and 12 show a series of operations when the car doors (2) and (3) are closed in a state where a string S passes through a central portion of the entrance of the elevator car and is stretched between the inside of the elevator car and a landing floor.

During closing of the car doors (2) and (3) from the fully opened state to the almost-fully closed state as illustrated in FIGS. 11(*a*), 11(*b*) and 11(*c*), the light beam B gradually approaches the string S, and during closing of the car doors (2) and (3) from the almost-fully closed state to the fully closed state as illustrated in FIGS. 12(*a*), 12(*b*) and 12(*c*), the light beam B crosses the string S. At this time, since the detection of the light beam by the light-emitting/light-receiving unit (4) is interrupted, a foreign matter detection signal is generated.

Figure 13A:
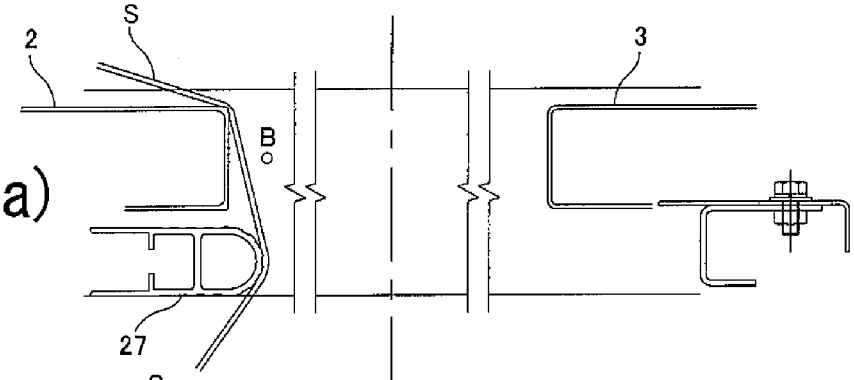
FIGS. 13(*a*)-13(*c*) are series of horizontal sectional views showing a former half of another example of a string detection operation.
Figure 13B:
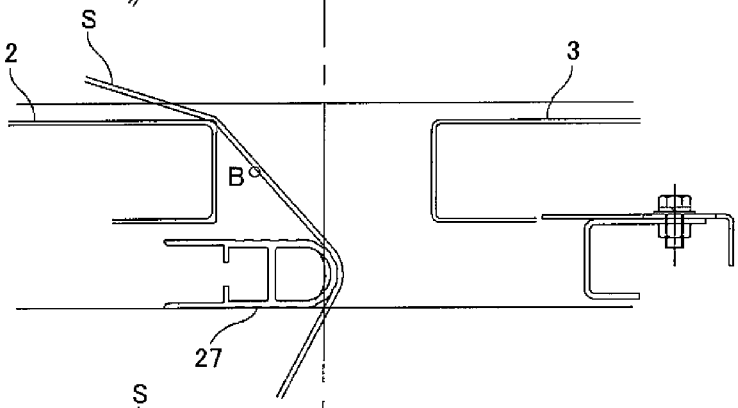
Figure 13C:
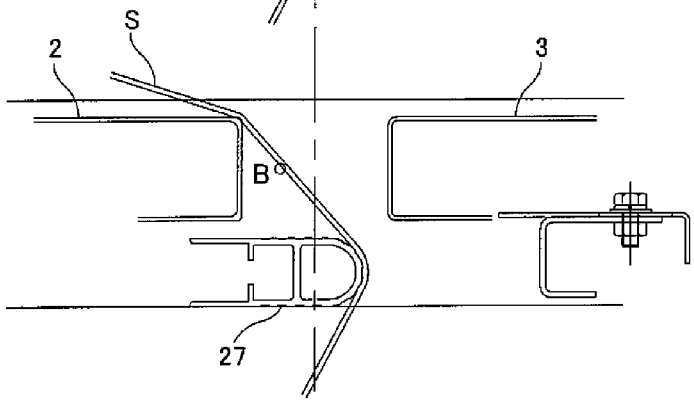
Figure 14A:
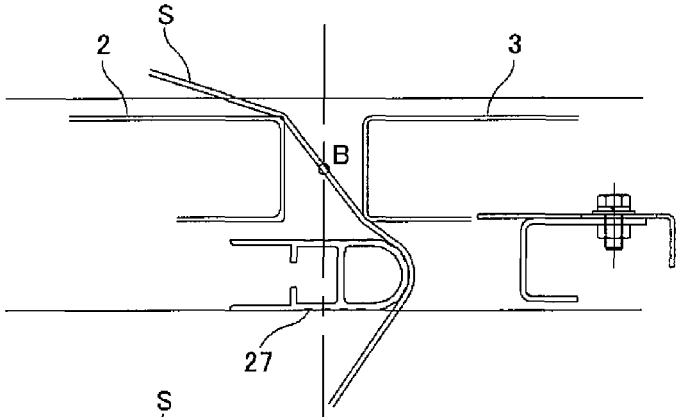
FIGS. 14(*a*)-14(*c*) are series of horizontal sectional views showing a latter half of the example of the string detection operation.
Figure 14B:
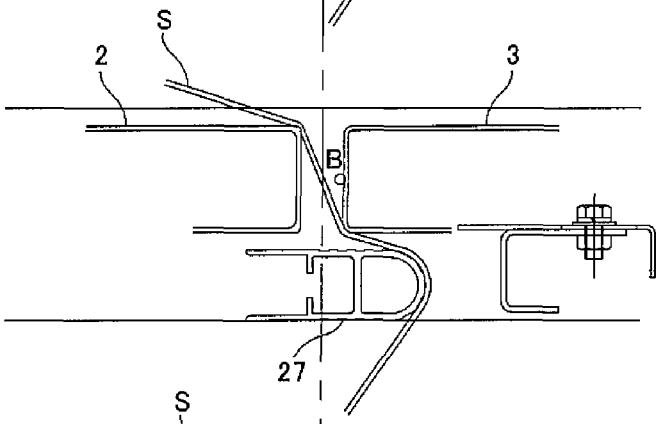
Figure 14C:
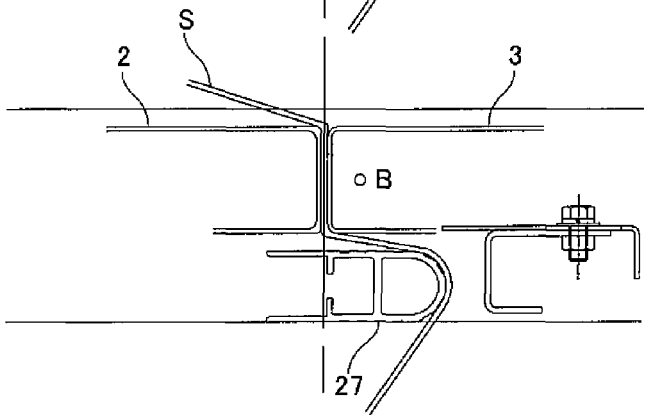

FIGS. 13 and 14 show a series of operations when the car doors (2) and (3) are closed in an elevator in which the safety shoe frame (27) is provided on the left car door (2) in a state where the string S is stretched between the inside of the elevator car and the landing floor in contact with the left car door (2) and the safety shoe frame (27).

During closing of the car doors (2) and (3) from the fully opened state to the almost-fully closed state as shown in FIGS. 13(*a*), 13(*b*) and 13(*c*), although the string S is first positioned between the light beam B and the left car door (2), as the door closing operation proceeds, the string S is moved to a position where the string S intersects the light beam B. Then, during closing of the car doors (2) and (3) from the almost-fully closed state to the fully closed state as shown in FIGS. 14(*a*), 14(*b*) and 14(*c*), the light beam B is moved to the outside of the string S. During the process, since the detection of the light beam by the light-emitting/light-receiving unit (4) is interrupted when the light beam B crosses the string S, a foreign matter detection signal is generated.

Figure 15A:
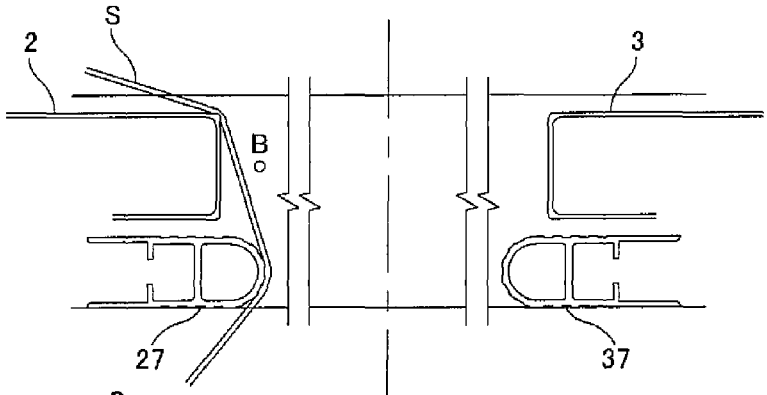
FIGS. 15(*a*)-15(*c*) are series of horizontal sectional views showing a former half of a further example of a string detection operation.
Figure 15B:
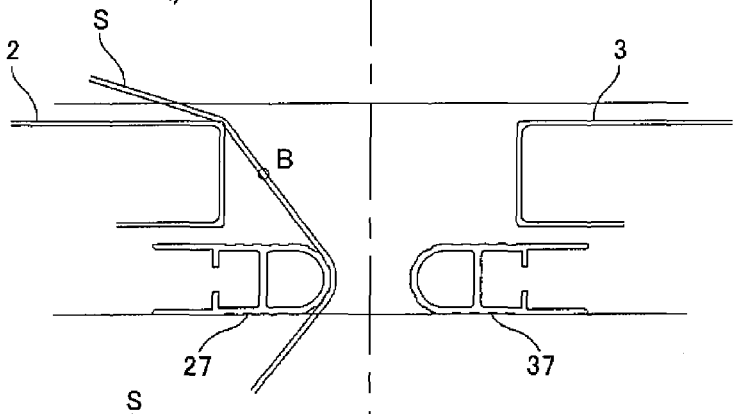
Figure 15C:
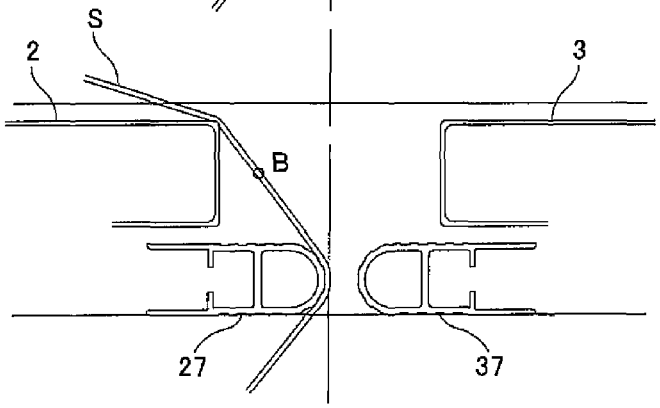
Figure 16A:
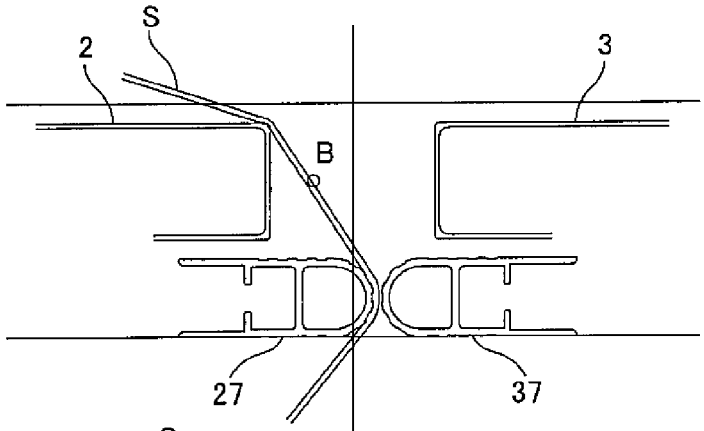
FIGS. 16(*a*)-16(*c*) are series of horizontal sectional views showing a latter half of the example of the string detection operation.
Figure 16B:
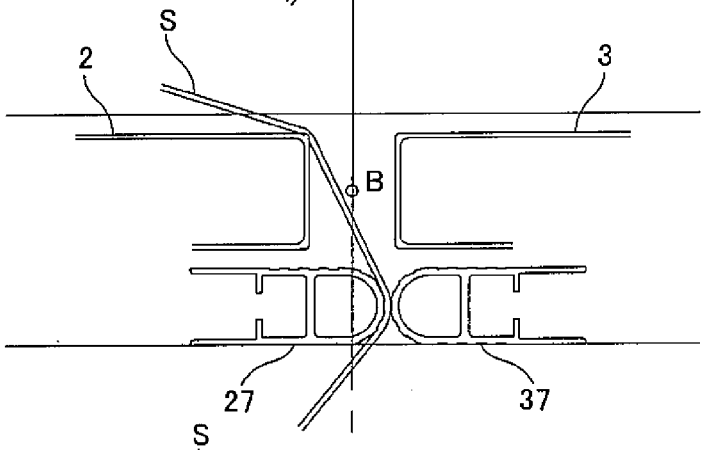
Figure 16C:
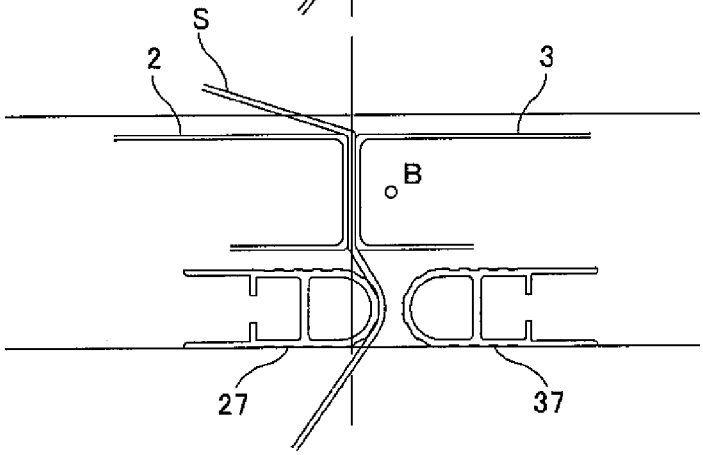

FIGS. 15 and 16 show a series of operations when the car doors (2) and (3) are closed in an elevator in which safety shoe frames (27) and (37) are provided on the car doors (2) and (3), respectively, in a state where the string S is stretched between the inside of the elevator car and the landing floor in contact with the left car door (2) and the safety shoe frame (27).

During closing of the car doors (2) and (3) from the fully opened state to the almost-fully closed state as shown in FIGS. 15(*a*), 15(*b*) and 15(*c*), although the string S is first positioned between the light beam B and the left car door (2), as the door closing operation proceeds, the string S is moved to a position where the string S intersects the light beam B. Then, during closing of the car doors (2) and (3) from the almost-fully closed state to the fully closed state as shown in FIGS. 16(*a*), 16(*b*) and 16(*c*), the light beam B is moved to the outside of the string S. During the process, since the detection of the light beam by the light-emitting/light-receiving unit (4) is interrupted when the light beam B crosses the string S, a foreign matter detection signal is generated.

Figure 17:
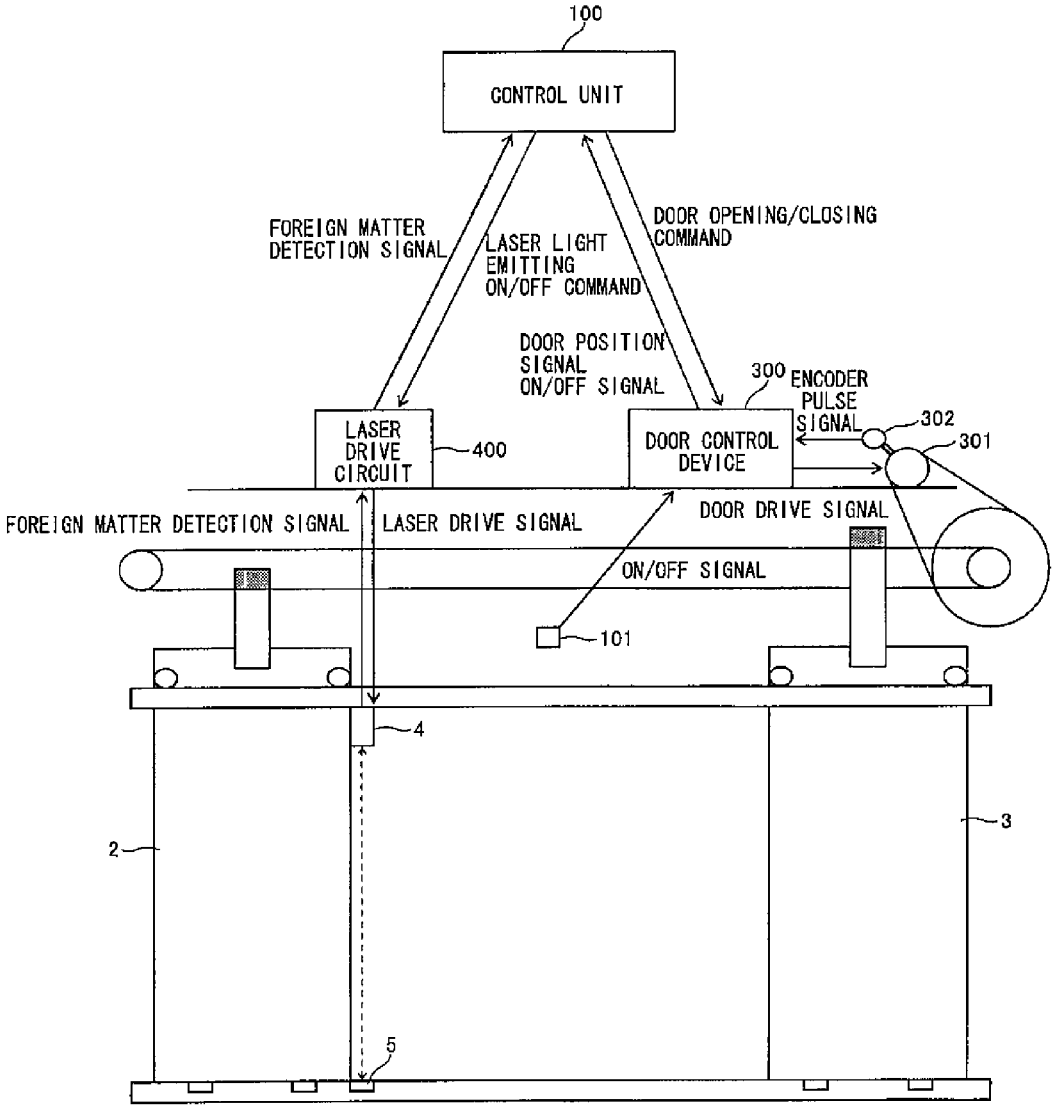
FIG. 17 is a block diagram showing an electrical configuration of the elevator.

FIG. 17 shows an electrical configuration of the elevator of this embodiment. A door control device (300) provides a door drive signal to a door drive motor (301), and thus the car doors (2) and (3) are closed and opened. To the door drive motor (301), a rotary encoder (302) is mounted, and an encoder pulse signal obtained from the rotary encoder (302) is provided to the door control device (300). The door control device (300) recognizes positions of the car doors (2) and (3) based on the encoder pulse signal, and a door position signal is provided to the control unit (100). The elevator includes a door closing end position detecting device (sometimes referred to as CTL) (101) that is switched from off to on when the car doors (2) and (3) are fully closed, and an on/off signal obtained from the door closing end position detecting device (101) is provided via the door control device (300) to the control unit (100). A door opening/closing command is provided from the control unit (100) to the door control device (300), and thus the door control device (300) is controlled.

The light emitting/receiving unit (4) has connected there to a laser drive circuit (400), which in turn is connected to the control unit (100). A laser light emitting on command and a laser light emitting off command are provided from the control unit (100) to the laser drive circuit (400), and the laser drive circuit (400) receives the laser light emitting on command and provides a laser drive signal to the light emitting/receiving unit (4), while receives the laser light emitting off command and stops providing the laser drive signal to the light emitting/receiving unit (4). The light emitting/receiving unit (4) receives the laser drive signal provided from the laser drive circuit (400) and performs the emission of the light beam, and stops the emission of the light beam when the provision of the laser drive signal is stopped. A foreign matter detection signal obtained from the light emitting/receiving unit (4) is provided via the laser drive circuit (400) to the control unit (100).

Figure 18:
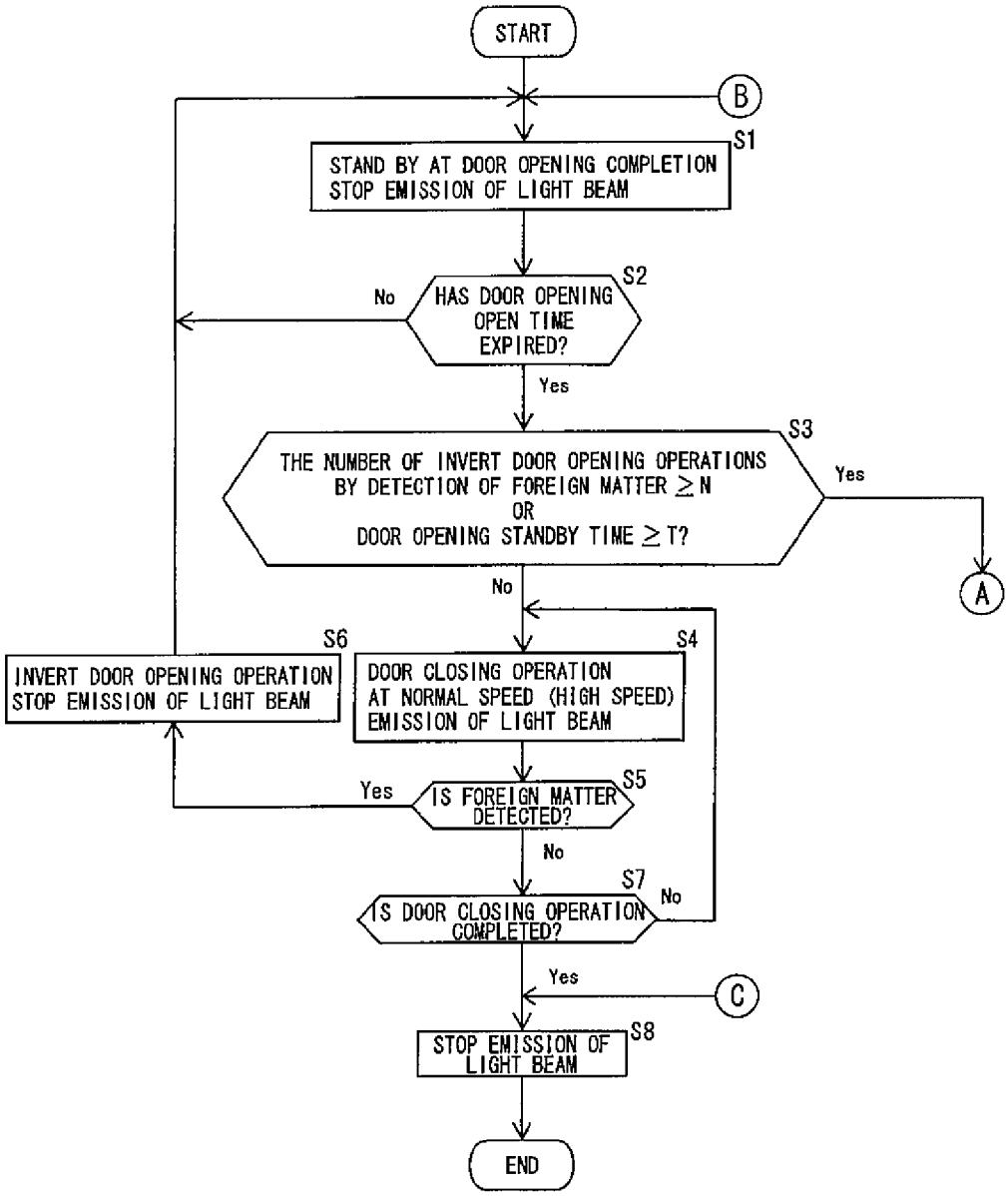
FIG. 18 is a flowchart showing a control procedure performed in an elevator according to a first embodiment.
Figure 19:
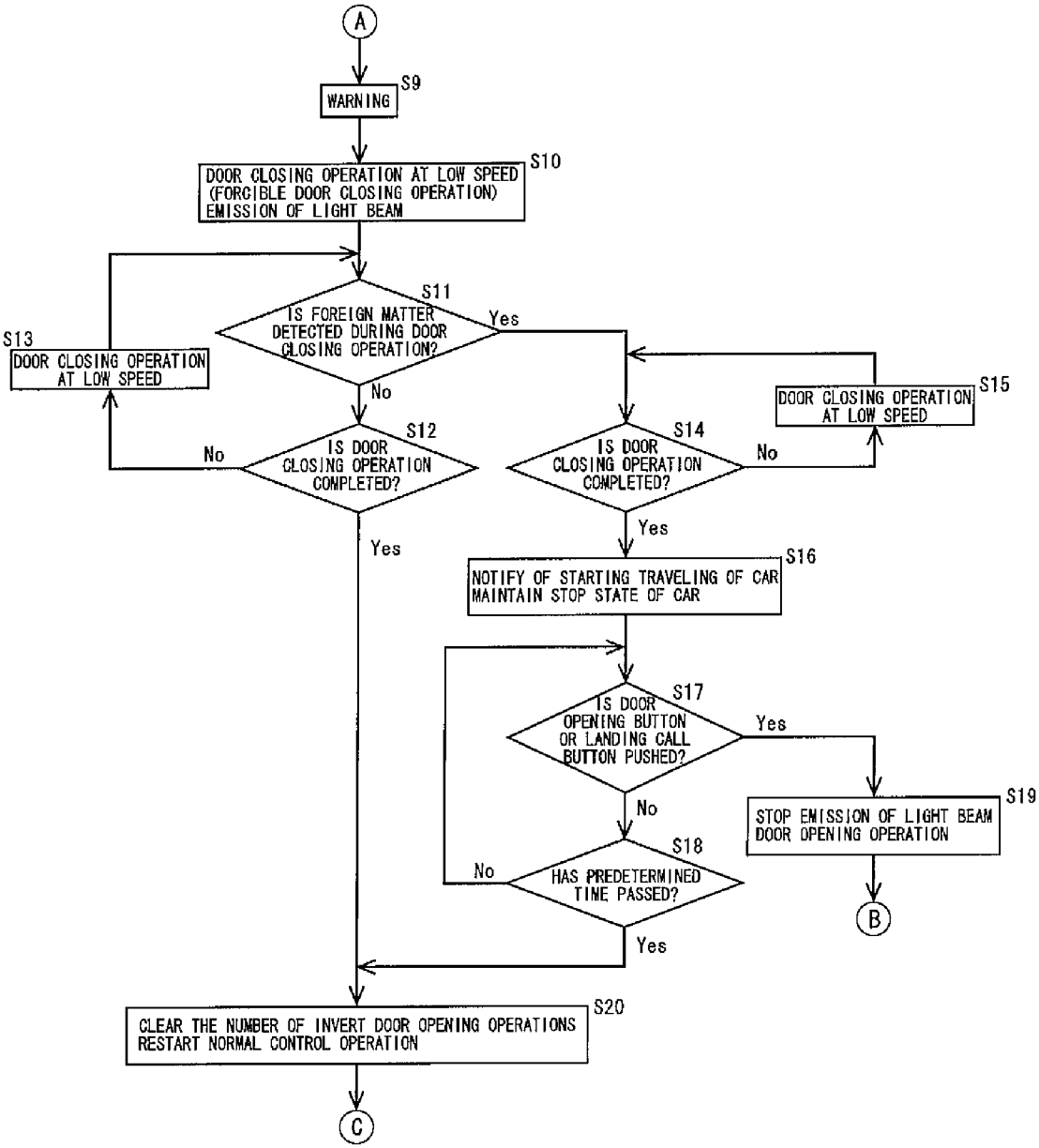
FIG. 19 is a separate view of FIG. 18.

FIGS. 18 and 19 show a control procedure performed by the control unit (100). First, in step S1 in FIG. 18, the control unit (100) stands by at door opening completion (fully opened state), and stops an emission of the light beam by the light emitting/receiving unit. Next, in step S2, the control unit (100) determines whether a door opening open time has expired. When it is determined No, the control unit (100) returns to step S1 and stands by at the door opening completion and continues an emission stop state of the light beam.

When the door opening open time has expired and it is determined Yes in step S2, the control unit (100) proceeds to step S3 to determine whether the current situation corresponds to a case where an invert door opening operation by detection of a foreign matter is repeated a predetermined number of times N or more or to a case where a door opening standby time reaches a predetermined time T.

When it is determined No in step S3, the control unit (100) proceeds to step S4 to perform a door closing operation at normal speed (high speed) and perform an emission of the light beam by the light emitting/receiving unit. Then, in step S5, the control unit (100) determines whether the foreign matter is detected.

When a foreign matter detection signal is generated or some force is applied to the safety shoe frame, it is supposed that there is a person or a foreign matter getting in or out of the entrance of the elevator car or a person is looking into the light beam. Thus, the control unit (100) proceeds to step S6 to perform an invert door opening operation and stop the emission of the light beam by the light emitting/receiving unit. Then, the control unit (100) returns to step S1 to stand by at door opening completion and continue the emission stop state of the light beam.

When it is determined in step S5 that no foreign matter is detected, the control unit (100) proceeds to step S7 to determine whether the door closing operation is completed based on the on/off signal obtained from the door closing end position detecting device. When it is determined No, the control unit (100) returns to step S4 to continue the door closing operation at normal speed and continue the emission of the light beam. Then, when the door closing operation is completed and it is determined Yes in step S7, in step S8, the control unit (100) stops the emission of the light beam by the light emitting/receiving unit, and finishes a series of procedures.

When a person mischievously or intentionally places some foreign matter at the entrance or an on-failure such that a foreign matter detection signal is always generated occurs in the light emitting/receiving unit, it is determined Yes in step S3, the control unit (100) proceeds to step S9 in FIG. 19 to notify of starting the door closing operation and issue a warning to move away from the car door using a voice guidance system in the elevator car or a display guidance system in the elevator car or the landing. Then, in step S10, a forcible door closing operation in which the car door is forcibly closed at low speed irrespective of whether or not the light emitting/receiving unit detects a foreign matter is performed with sounding of a buzzer, and the light emitting/receiving unit starts the emission of the light beam. During the forcible door closing operation, even if the light emitting/receiving unit generates a foreign matter detection signal, an invert door opening operation is not performed, and the invert door opening operation by detection of the foreign matter by the light emitting/receiving unit is canceled. On the other hand, when the safety shoe frame detects a foreign matter, the invert door opening operation is performed.

Then, in step S11, it is determined whether the light emitting/receiving unit detects a foreign matter during the forcible door closing operation.

When no foreign matter detection signal is generated, the control unit (100) proceeds to step S12 to determine whether the forcible door closing operation is completed based on the on/off signal obtained from the door closing end position detecting device. When it is determined No, in step S13, the control unit (100) continues the forcible door closing operation and then returns to step S11. Then, when the forcible door closing operation is completed and it is determined Yes in step S12, the control unit (100) proceeds to step S20 to clear the number of invert door opening operations and restart a normal control operation. Thus, the elevator car can start traveling. Finally, the control unit (100) proceeds to step S8 in FIG. 18 to stop the emission of the light beam by the light emitting/receiving unit, and finishes the series of procedures.

When the light emitting/receiving unit detects a foreign matter during the forcible door closing operation, and it is determined Yes in step S11 in FIG. 19, the control unit (100) proceeds to step S14 to determine whether the forcible door closing operation is completed based on the on/off signal obtained from the door closing end position detecting device. When it is determined No, the control unit (100) continues the forcible door closing operation in step S15 and then returns to step S14. Then, when the forcible door closing operation is completed and it is determined Yes in step S14, the control unit (100) proceeds to step S16 to notify of starting traveling of the elevator car using a voice guidance system in the elevator car or a display guidance system in the elevator car or the landing, and maintain a stop state of the elevator car during this operation. In notification with voice, the volume may be larger than the voice for the notification and warning in step S9. Then, in step S17, it is determined whether a door opening button in the elevator car or a landing call button provided on a stop floor of the elevator car is pushed. When it is determined No, the control unit (100) proceeds to step S18 to determine whether a predetermined time, for example, two seconds has passed after the notification of starting traveling of the elevator car is finished. When it is determined No, the control unit (100) returns to step S17 to repeat determination whether the door opening button or the landing call button is pushed.

When the door opening button or the landing call button is pushed after the notification of starting traveling of the elevator car is finished and before the predetermined time has passed, in step S19, the emission of the light beam by the light emitting/receiving unit is stopped and a door opening operation is performed. This can remove a foreign matter caught between the car doors during the forcible door closing operation. Then, the control unit (100) returns to step S1 in FIG. 18 and stands by at door opening completion.

In contrast, when the predetermined time has passed without the door opening button or the landing call button pushed after the notification of starting traveling of the elevator car is finished, in step S20 in FIG. 19, the number of invert door opening operations is cleared and a normal control operation is restarted. Thus, the elevator car can start traveling. Finally, the control unit (100) proceeds to step S8 in FIG. 18 to stop the emission of the light beam by the light emitting/receiving unit, and finishes the series of procedures.

According to the procedures, the emission of the light beam from the light emitting/receiving unit (4) is stopped during standby in the door opening state, and at the start of the door closing operation, the emission of the light beam from the light emitting/receiving unit (4) is started.

Then, when a foreign matter detection signal is generated during the door closing operation or some force is applied to the safety shoe frame, the invert door opening operation is performed and the emission of the light beam from the light emitting/receiving unit (4) is stopped. In contrast, when the door closing operation is completed without any foreign matter detected, the emission of the light beam from the light emitting/receiving unit (4) is stopped at the time of the completion.

When the invert door opening operation by detection of the foreign matter is repeated the predetermined number of times N or more or when the door opening standby time reaches the predetermined time T, the forcible door closing operation is started after the notification of starting the forcible door closing operation. Further, when the light emitting/receiving unit (4) detects a foreign matter during the forcible door closing operation, a notification of starting traveling of the elevator car after completion of the forcible door closing operation is made, and then traveling of the elevator car is started.

In the elevator of this embodiment, the emission of the light beam from the light emitting/receiving unit (4) is stopped during the door opening standby and the normal door opening operation, thereby preventing the light beam from being looked into during the door opening standby and the normal door opening operation.

When a foreign matter is detected during the door closing operation, the invert door opening operation is performed. At this time, the emission of the light beam from the light emitting/receiving unit (4) is stopped. This can prevent the light beam from being looked into during the invert door opening operation.

If during the door closing operation a person tries to place his/her head or shoulder in the entrance to look into the light beam emitted from the light emitting/receiving unit (4), the light emitting/receiving unit (4) detects the person's head or shoulder as a foreign matter, and thus the invert door opening operation is performed and the emission of the light beam from the light emitting/receiving unit (4) is stopped. Even if the light emitting/receiving unit (4) does not detect the person's head or shoulder as a foreign matter, the person's head or shoulder bumps into the safety shoe frame, and thus the invert door opening operation is performed and the emission of the light beam from the light emitting/receiving unit (4) is stopped. Thus, it is impossible to look into the light beam emitted from the light emitting/receiving unit (4) during the door closing operation, thereby preventing the light beam from being looked into during the door closing operation.

Further, since starting the forcible door closing operation is notified before the forcible door closing operation is started, an accident can be prevented that a passenger is caught between the car door and the landing door at the completion of the forcible door closing operation. When the light emitting/receiving unit (4) still detects a foreign matter during the forcible door closing operation in spite of the fact that starting the forcible door closing operation is notified, this situation is notified after the forcible door closing operation is completed and before the traveling of the elevator car is started. Thus, if a person mischievously or intentionally stretches, for example, a string-like foreign matter between the elevator car and the landing floor, an accident can be prevented that the traveling of the elevator car is started with the foreign matter caught between the car door and the landing door after the forcible door closing operation is completed.

Second Embodiment

In the elevator of the first embodiment, the emission of the light beam by the light emitting/receiving unit (4) is started at the start of the door closing operation, while in an elevator of this embodiment, the emission is started when the car doors (2) and (3) are closed to a predetermined closed position after the door closing operation is started. The entire configuration and an electrical configuration of the elevator of this embodiment are the same as those in the elevator of the first embodiment except a control unit, and thus descriptions thereof will be omitted.

Figure 20:
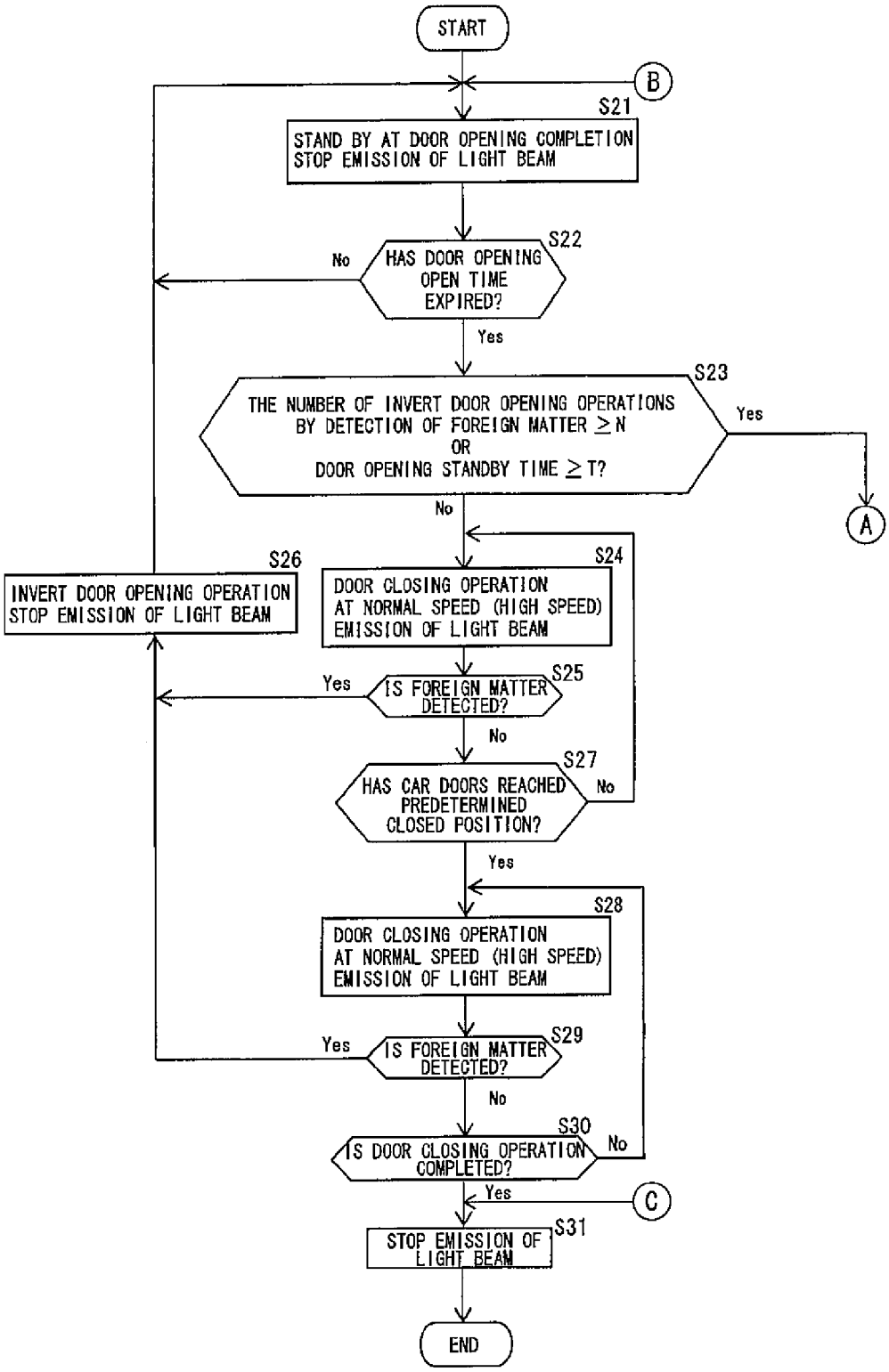
FIG. 20 is a flowchart showing a control procedure performed in an elevator according to a second embodiment.
Figure 21:
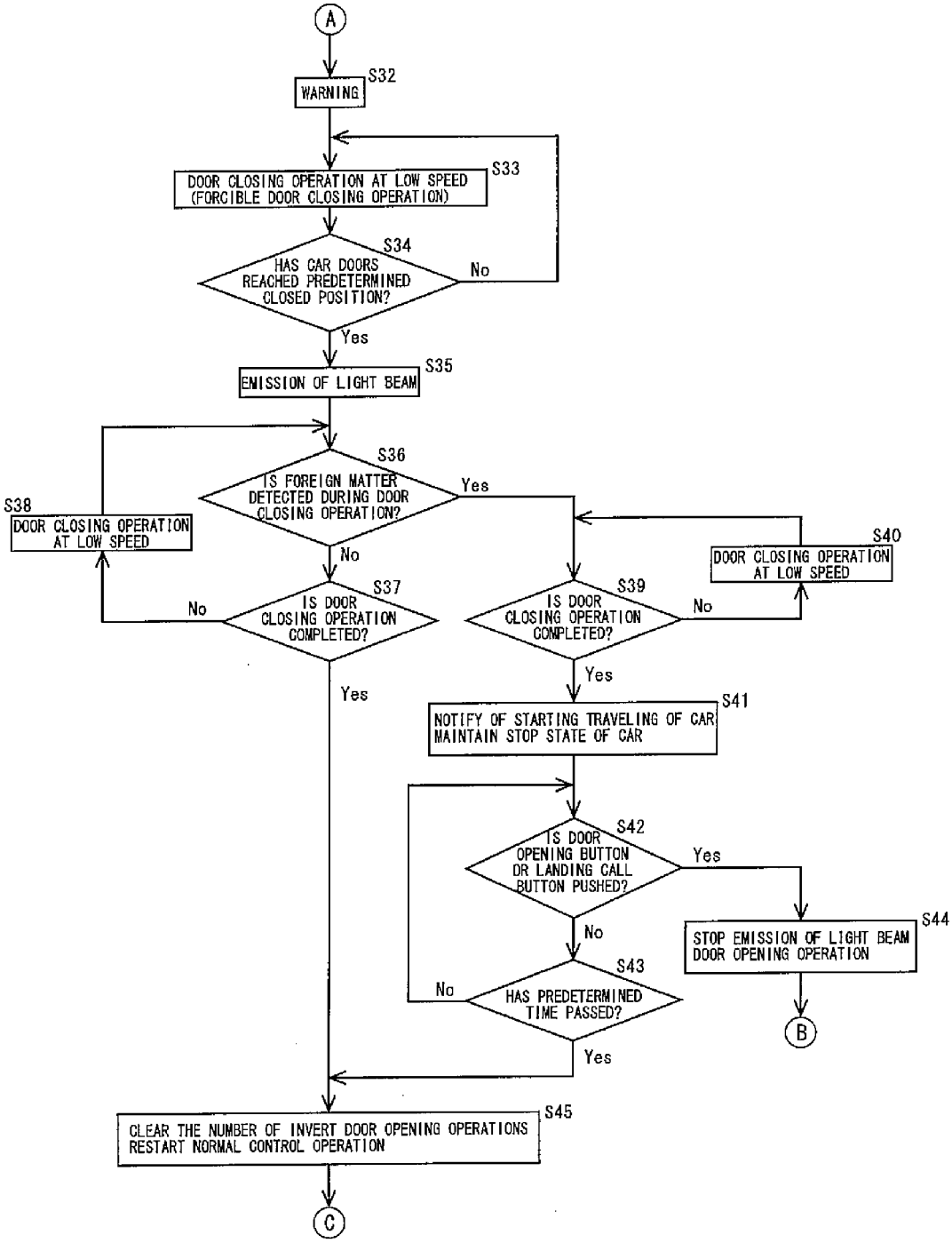
FIG. 21 is a separate view of FIG. 20.

FIGS. 20 and 21 show a control procedure performed by the control unit of this embodiment. First, in step S21 in FIG. 20, the control unit stands by at door opening completion (fully opened state) and stops an emission of a light beam by the light emitting/receiving unit. Then, in step S22, the control unit determines whether a door opening open time has expired. When it is determined No, the control unit returns to step S21 and stands by at the door opening completion and continues an emission stop state of the light beam.

When the door opening open time has expired and it is determined Yes in step S22, the control unit proceeds to step S23 to determine whether the current situation corresponds to a case where an invert door opening operation is repeated a predetermined number of times N or more by detection of a foreign matter or a case where a door opening standby time reaches a predetermined time T.

When it is determined No in step S23, the control unit proceeds to step S24 to perform the door closing operation at normal speed (high speed) and continue the emission stop state of the light beam. Then, in step S25, the control unit determines whether the foreign matter is detected.

When some force is applied to the safety shoe frame, it is supposed that there is a person or a foreign matter getting in or out of the entrance of the elevator car. Thus, the control unit proceeds to step S26 to perform an invert door opening operation and continues the emission stop state of the light beam. Then, the control unit returns to step S21 to stand by at door opening completion and continue the emission stop state of the light beam.

When it is determined in step S25 that no foreign matter is detected, the control unit proceeds to step S27 to determine whether the car doors have reached a predetermined closed position based on a door position signal obtained from a door control device. When it is determined No, the control unit returns to step S24 to continue the door closing operation at normal speed and continue the emission stop state of the light beam. The predetermined closed position is set in a position where a width between end surfaces in a closing direction of the car doors to abut against each other is such a width that a person's head or shoulder cannot enter between the end surfaces, for example, 70 mm.

Then, when the car doors reach the predetermined closed position and it is determined Yes in step S27, the control unit proceeds to step S28 to continue the door closing operation at normal speed and perform the emission of the light beam by the light emitting/receiving unit. Then, in step S29, the control unit determines whether the foreign matter is detected.

When a foreign matter detection signal is generated or some force is applied to the safety shoe frame, it is supposed that there is a foreign matter at the entrance of the elevator car. Thus, the control unit proceeds to step S26 to perform the invert door opening operation and stop the emission of the light beam by the light emitting/receiving unit. Then, the control unit returns to step S21 to stand by at door opening completion and continue the emission stop state of the light beam.

When it is determined in step S29 that no foreign matter is detected, the control unit proceeds to step S30 to determine whether the door closing operation is completed based on an on/off signal obtained from the door closing end position detecting device. When it is determined No, the control unit returns to step S28 to continue the door closing operation at normal speed and continue the emission of the light beam. Then, when the door closing operation is completed and it is determined Yes in step S30, in step S31, the control unit stops the emission of the light beam by the light emitting/receiving unit, and finishes a series of procedures.

When a person mischievously or intentionally places some foreign matter at the entrance or an on-failure such that a foreign matter detection signal is always generated occurs in the light emitting/receiving unit, it is determined Yes in step S23, and the control unit proceeds to step S32 in FIG. 21 to notify of starting the door closing operation and issue a warning to move away from the car door using a voice guidance system in the elevator car or a display guidance system in the elevator car or the landing. Then, in step S33, a forcible door closing operation in which the car door is forcibly closed at low speed irrespective of whether or not the light emitting/receiving unit detects a foreign matter is performed with sounding of a buzzer. During the forcible door closing operation, even if the light emitting/receiving unit generates a foreign matter detection signal, an invert door opening operation is not performed, and the invert door opening operation by detection of the foreign matter by the light emitting/receiving unit is canceled. On the other hand, when the safety shoe frame detects a foreign matter, the invert door opening operation is performed.

Then, in step S34, it is determined whether the car doors have reached the predetermined closed position based on the door position signal obtained from the door control device. When it is determined No, the control unit returns to step S33 to continue the forcible door closing operation.

Then, when the car doors reach the predetermined closed position and it is determined Yes in step S34, the control unit proceeds to step S35 to start the emission of the light beam by the light emitting/receiving unit. Then, in step S36, the control unit determines whether the light emitting/receiving unit detects a foreign matter during the forcible door closing operation.

When no foreign matter detection signal is generated, the control unit proceeds to step S37 to determine whether the forcible door closing operation is completed based on the on/off signal obtained from the door closing end position detecting device. When it is determined No, in step S38, the control unit continues the forcible door closing operation and then returns to step S36. Then, when the forcible door closing operation is completed and it is determined Yes in step S37, the control unit proceeds to step S45 to clear the number of invert door opening operations and restart a normal control operation. Thus, the elevator car can start traveling. Finally, the control unit proceeds to step S31 in FIG. 20 to stop the emission of the light beam by the light emitting/receiving unit, and finishes the series of procedures.

When the light emitting/receiving unit detects a foreign matter during the forcible door closing operation, and it is determined Yes in step S36 in FIG. 21, the control unit proceeds to step S39 to determine whether the forcible door closing operation is completed based on the on/off signal obtained from the door closing end position detecting device. When it is determined No, the control unit continues the forcible door closing operation in step S40 and then returns to step S39. Then, when the forcible door closing operation is completed and it is determined Yes in S39, the control unit proceeds to step S41 to notify of starting traveling of the elevator car using a voice guidance system in the elevator car or a display guidance system in the elevator car or the landing, and maintain a stop state of the elevator car during this operation. In notification with voice, the volume may be larger than the voice for the notification and warning in step S32. Then, in step S42, it is determined whether a door opening button in the elevator car or a landing call button provided on a stop floor of the elevator car is pushed. When it is determined No, the control unit proceeds to step S43 to determine whether a predetermined time, for example, two seconds has passed after the notification of starting traveling of the elevator car is finished. When it is determined No, the control unit returns to step S42 to repeat determination whether the door opening button or the landing call button is pushed.

When the door opening button or the landing call button is pushed after the notification of starting traveling of the elevator car is finished and before the predetermined time has passed, in step S44, the emission of the light beam by the light emitting/receiving unit is stopped and a door opening operation is performed. This can remove a foreign matter caught between the car doors during the forcible door closing operation. Then, the control unit returns to step S31 in FIG. 20 and stands by at door opening completion.

In contrast, when the predetermined time has passed without the door opening button or the landing call button pushed after the notification of starting traveling of the elevator car is finished, in step S45 in FIG. 21, the number of invert door opening operations is cleared and a normal control operation is restarted. Thus, the elevator car can start traveling. Finally, the control unit proceeds to step S31 in FIG. 20 to stop the emission of the light beam by the light emitting/receiving unit, and finishes the series of procedures.

According to the procedures, emission of the light beam from the light emitting/receiving unit (4) is stopped during standby in the door opening state, and after the start of the door closing operation and until closing of the car doors (2) and (3) to the predetermined closed position, and the emission of the light beam from the light emitting/receiving unit (4) is started at the time of closing of the car doors (2) and (3) to the predetermined closed position.

Until the car doors (2) and (3) are closed to the predetermined closed position, when some force is applied to the safety shoe frame, the emission stop state of the light beam is maintained and the invert door opening operation is performed. After the car doors (2) and (3) are closed to the predetermined closed position, when a foreign matter detection signal is generated or some force is applied to the safety shoe frame, the invert door opening operation is performed and the emission of the light beam from the light emitting/receiving unit (4) is stopped. In contrast, when the door closing operation is completed without any foreign matter detected, the emission of the light beam from the light emitting/receiving unit (4) is stopped at the time of the completion.

Further, when the invert door opening operation is repeated the predetermined number of times N or more by detection of the foreign matter or when the door opening standby time reaches the predetermined time T, the forcible door closing operation is started after the notification of starting the forcible door closing operation. Further, when the light emitting/receiving unit (4) detects a foreign matter during the forcible door closing operation, a notification of starting traveling of the elevator car after completion of the forcible door closing operation is made, and then traveling of the elevator car is started.

In the elevator of this embodiment, the emission of the light beam from the light emitting/receiving unit (4) is stopped during the door opening standby and the normal door opening operation, thereby preventing the light beam from being looked into during the door opening standby and the normal door opening operation.

During the door closing operation and during the forcible door closing operation, the emission of the light beam by the light emitting/receiving unit (4) is started when the car doors (2) and (3) are closed to the predetermined closed position. Thus, it is physically impossible for a person to place his/her head or shoulder in the entrance to look into the light beam after the start of the emission of the light beam, thereby preventing the light beam from being looked into during the door closing operation.

Further, when a foreign matter is detected during the door closing operation, the invert door opening operation is performed. At this time, the emission of the light beam from the light emitting/receiving unit (4) is stopped, thereby preventing the light beam from being looked into during the invert door opening operation.

Further, since starting the forcible door closing operation is notified before the forcible door closing operation is started, an accident can be prevented that a passenger is caught between the car door and the landing door at the completion of the forcible door closing operation. When the light emitting/receiving unit (4) still detects a foreign matter during the forcible door closing operation in spite of the fact that starting the forcible door closing operation is notified, this situation is notified after the forcible door closing operation is completed and before the traveling of the elevator car is started. Thus, an accident can be prevented that the traveling of the elevator car is started with a string-like foreign matter caught between the car door and the landing door after the forcible door closing operation is completed.

Third Embodiment

In an elevator of this embodiment, the light emitting/receiving unit (4) detects a foreign matter during the door closing operation and also during standby in the door opening state. The entire configuration and an electrical configuration of the elevator of this embodiment are the same as those in the elevator of the first embodiment except a control unit, and thus descriptions thereof will be omitted.

Figure 22:
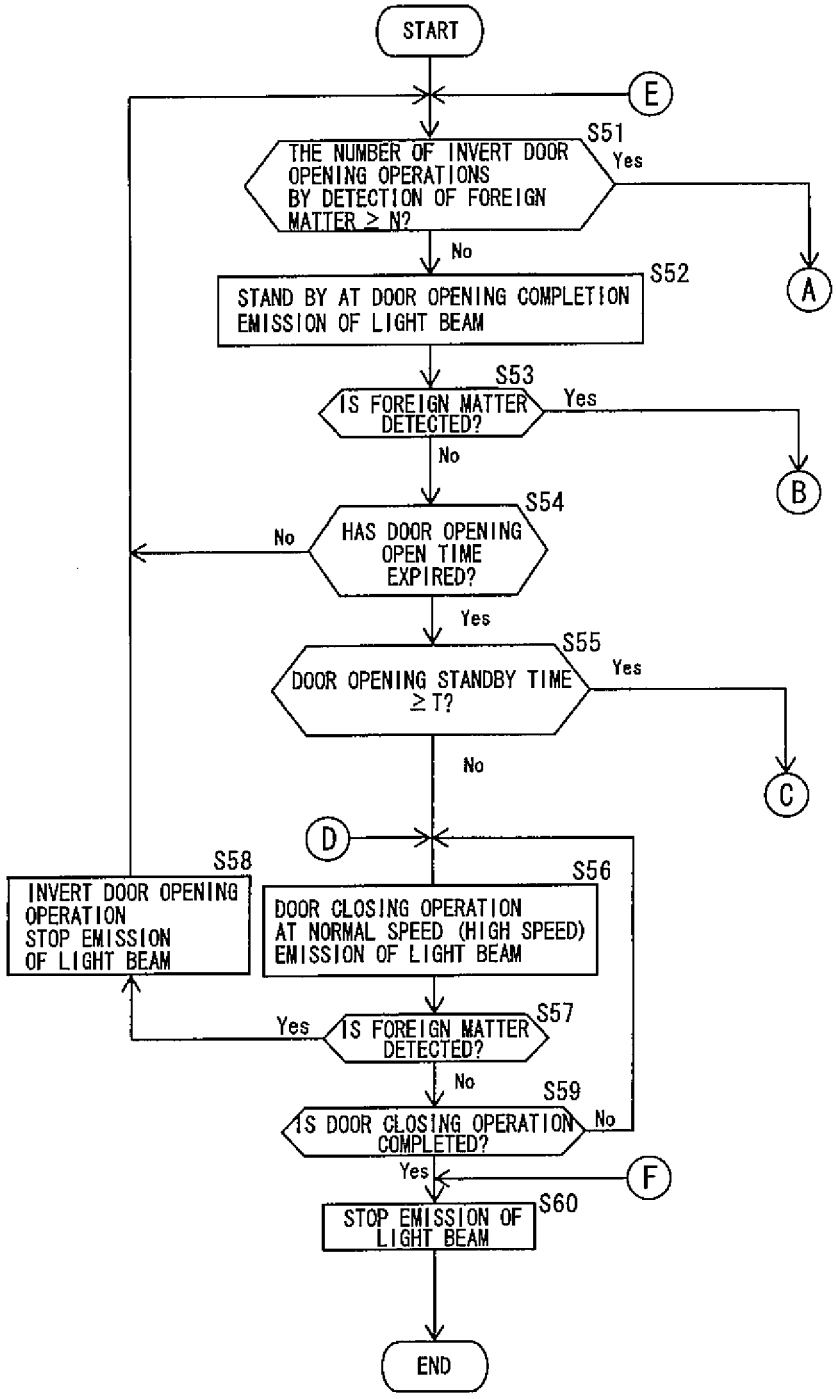
FIG. 22 is a flowchart showing a control procedure performed in an elevator according to a third embodiment.
Figure 23:
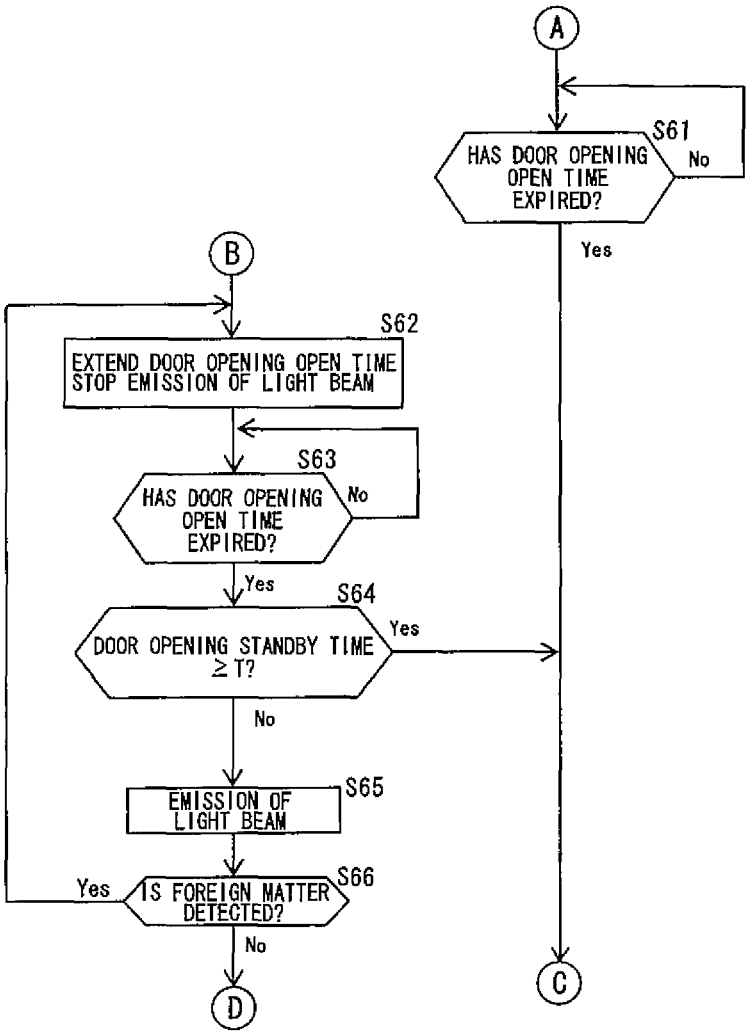
FIG. 23 is a first separate view of FIG. 22.
Figure 24:
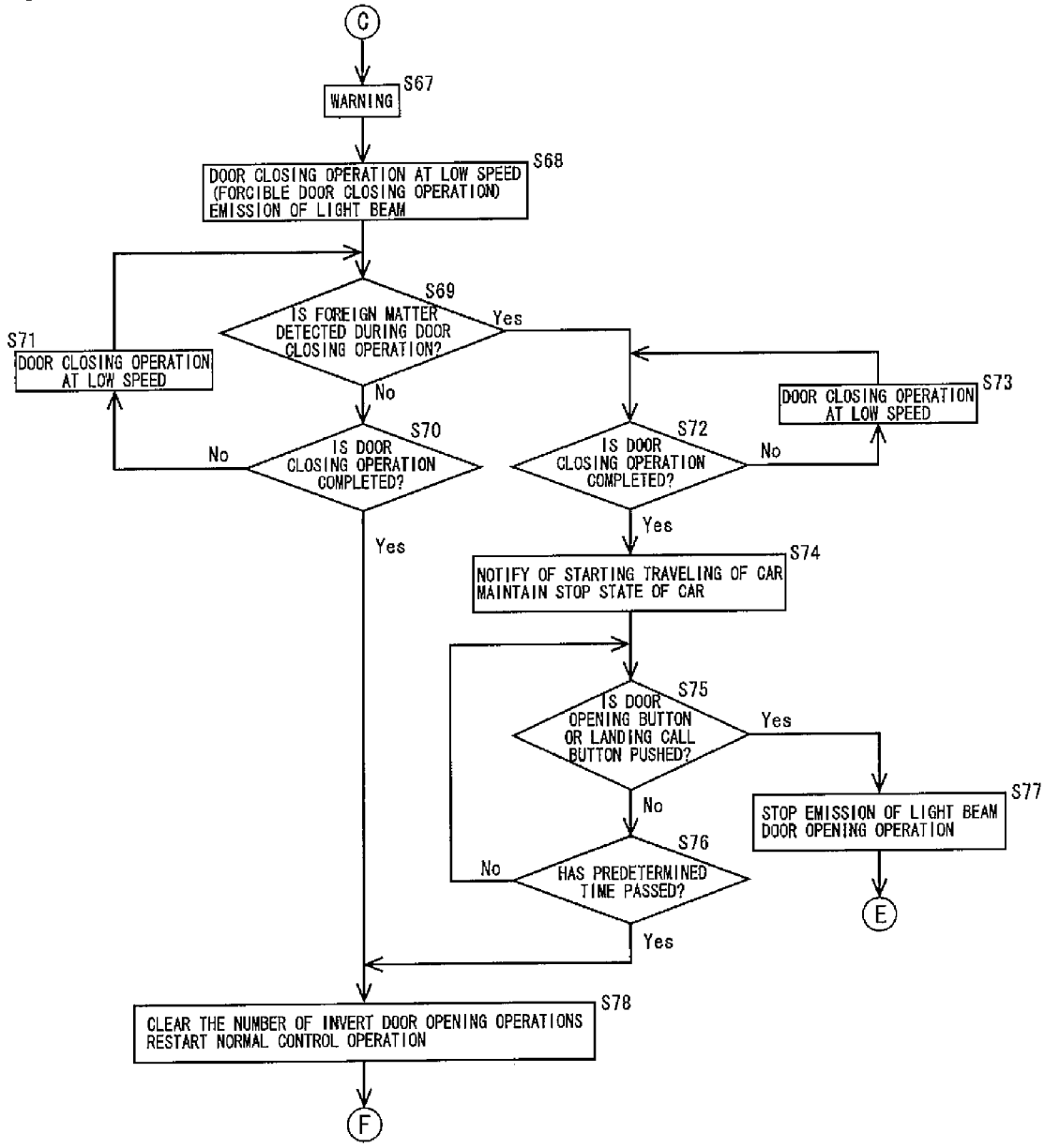
FIG. 24 is a second separate view of FIG. 22.

FIGS. 22 to 24 show a control procedure performed by the control unit of this embodiment. First, in step S51 in FIG. 22, it is determined whether an invert door opening operation is repeated a predetermined number of times N or more by detection of a foreign matter. When it is determined No, the control unit proceeds to step S52 to stand by at door opening completion (fully opened state) and perform an emission of the light beam by light emitting/receiving unit. Then, in step S53, the light emitting/receiving unit detects a foreign matter.

When it is determined No in step S53, the control unit proceeds to step S54 to determine whether a door opening open time has expired. When it is determined Yes, in step S55, the control unit determines whether a door opening standby time has reached a predetermined time T. When it is determined No, the control unit proceeds to step S56 to perform a door closing operation at normal speed (high speed) and perform an emission of the light beam by the light emitting/receiving unit. Then, in step S57, the control unit determines whether the foreign matter is detected.

When a foreign matter detection signal is generated or some force is applied to the safety shoe frame, it is supposed that there is a person or a foreign matter getting in or out of the entrance of the elevator car or a person is looking into the light beam. Thus, the control unit proceeds to step S58 to perform an invert door opening operation and stop the emission of the light beam by the light emitting/receiving unit. Then, the control unit returns to step S51 to determine whether the invert door opening operation is repeated the predetermined number of times N or more by detection of the foreign matter.

When it is determined in step S57 that no foreign matter is detected, the control unit proceeds to step S59 to determine whether the door closing operation is completed based on an on/off signal obtained from the door closing end position detecting device. When it is determined No, the control unit returns to step S56 to continue the door closing operation at normal speed and continue the emission of the light beam. Then, when the door closing operation is completed and it is determined Yes in step S59, in step S60, the control unit stops the emission of the light beam by the light emitting/receiving unit, and finishes a series of procedures.

When a foreign matter detection signal is generated during standby in the door opening state and it is determined Yes in step S53, it is supposed that there is a person or a foreign matter getting in or out of the entrance of the elevator car or a person is looking into the light beam. Thus, the control unit proceeds to step S62 in FIG. 23 to extend a door opening open time for several seconds and stop the emission of the light beam by the light emitting/receiving unit. Then, the control unit determines in step S63 whether the door opening open time has expired. When it is determined No, the control unit repeats the same determination in step S63. Then, when the door opening open time has expired and it is determined Yes in step S63, the control unit proceeds to step S64 to determine whether the door opening standby time has reached a predetermined time T. When it is determined No, the control unit proceeds to step S65 to perform the emission of the light beam by the light emitting/receiving unit. Then, in step S66, the control unit determines whether the light emitting/receiving unit detects a foreign matter. When a foreign matter detection signal is generated, it is supposed that a foreign matter remains at the entrance or a person continues looking into the light beam. Thus, the control unit returns to step S62 to extend the door opening open time and stop the emission of the light beam by the light emitting/receiving unit. When it is determined No in step S66, the control unit proceeds to step S56 in FIG. 22 to perform the door closing operation at normal speed (high speed) and continue the emission of the light beam by the light emitting/receiving unit.

When the door opening standby time has reached the predetermined time T and it is determined Yes in step S64 in FIG. 23, the control unit proceeds to step S67 in FIG. 24.

When the invert door opening operation by detection of the foreign matter is repeated the predetermined number of times N or more and it is determined Yes in step S51 in FIG. 22, the control unit proceeds to step S61 in FIG. 23 to determine whether the door opening open time has expired. When it is determined No, the control unit repeats the same determination in step S61. Then, when the door opening open time has expired and it is determined Yes in step S61, the control unit proceeds to step S67 in FIG. 24. Also when the door opening standby time has reached the predetermined time T and it is determined Yes in step S55 in FIG. 22, the control unit proceeds to step S67 in FIG. 24.

In step S67, the control unit notifies of starting the door closing operation and issues a warning to move away from the car door using a voice guidance system in the elevator car or a display guidance system in the elevator car or the landing. Then, in step S68, a forcible door closing operation in which the car door is forcibly closed at low speed irrespective of whether or not the light emitting/receiving unit detects a foreign matter is performed with sounding of a buzzer, and the light emitting/receiving unit starts the emission of the light beam. During the forcible door closing operation, even if the light emitting/receiving unit generates a foreign matter detection signal, an invert door opening operation is not performed, and the invert door opening operation by detection of the foreign matter by the light emitting/receiving unit is canceled. On the other hand, when the safety shoe frame detects a foreign matter, the invert door opening operation is performed.

Then, in step S69, it is determined whether the light emitting/receiving unit detects a foreign matter during the forcible door closing operation.

When no foreign matter detection signal is generated, the control unit proceeds to step S70 to determine whether the forcible door closing operation is completed based on the on/off signal obtained from the door closing end position detecting device. When it is determined No, in step S71, the control unit continues the forcible door closing operation and then returns to step S69. Then, when the forcible door closing operation is completed and it is determined Yes in step S70, the control unit proceeds to step S78 to clear the number of invert door opening operations and restart a normal control operation. Thus, the elevator car can start traveling. Finally, the control unit proceeds to step S60 in FIG. 22 to stop the emission of the light beam by the light emitting/receiving unit, and finishes the series of procedures.

When the light emitting/receiving unit detects a foreign matter during the forcible door closing operation, and it is determined Yes in step S69 in FIG. 24, the control unit proceeds to step S72 to determine whether the forcible door closing operation is completed based on the on/off signal obtained from the door closing end position detecting device. When it is determined No, the control unit continues the forcible door closing operation in step S73 and then returns to step S72. Then, when the forcible door closing operation is completed and it is determined Yes in step S72, the control unit proceeds to step S74 to notify of starting traveling of the elevator car using a voice guidance system in the elevator car or a display guidance system in the elevator car or the landing, and maintain a stop state of the elevator car during this operation. In notification with voice, the volume may be larger than the voice for the notification and warning in step S67. Then, in step S75, it is determined whether a door opening button in the elevator car or a landing call button provided on a stop floor of the elevator car is pushed. When it is determined No, the control unit proceeds to step S76 to determine whether a predetermined time, for example, two seconds has passed after the notification of starting traveling of the elevator car is finished. When it is determined No, the control unit returns to step S75 to repeat determination whether the door opening button or the landing call button is pushed.

When the door opening button or the landing call button is pushed after the notification of starting traveling of the elevator car is finished and before the predetermined time has passed, in step S77, the emission of the light beam by the light emitting/receiving unit is stopped and a door opening operation is performed. This can remove a foreign matter caught between the car doors during the forcible door closing operation. Then, the control unit returns to step S51 in FIG. 22.

In contrast, when the predetermined time has passed without the door opening button or the landing call button pushed after the notification of starting traveling of the elevator car is finished, in step S78 in FIG. 24, the number of invert door opening operations is cleared and a normal control operation is restarted. Thus, the elevator car can start traveling. Finally, the control unit proceeds to step S60 in FIG. 22 to stop the emission of the light beam by the light emitting/receiving unit, and finishes the series of procedures.

According to the procedures, the emission of the light beam by the light emitting/receiving unit (4) is performed during standby in the door opening state, and when a foreign matter detection signal is generated during standby in the door opening state, the door opening open time is extended several minutes and the emission of the light beam from the light emitting/receiving unit (4) is stopped. Then, at the time when the extended door opening open time has expired, the emission of the light beam by the light emitting/receiving unit (4) is restarted to restart the foreign matter detection operation. When a foreign matter detection signal is again generated at the time, it is supposed that a foreign matter remains at the entrance, or a person continues looking into the light beam. Thus, the door opening open time is again extended for several seconds and the emission of the light beam from the light emitting/receiving unit (4) is stopped. In contrast, when no foreign matter detection signal is generated at the restart of the foreign matter detection operation, the door closing operation is started, and the light beam emission by the light emitting/receiving unit (4) is continued.

The emission of the light beam by the light emitting/receiving unit (4) is performed also during the door closing operation, and when a foreign matter detection signal is generated during the door closing operation or some force is applied to the safety shoe frame, the invert door opening operation is performed and the emission of the light beam from the light emitting/receiving unit (4) is stopped. In contrast, when the door closing operation is completed without any foreign matter detected, the emission of the light beam from the light emitting/receiving unit (4) is stopped at the time of the completion.

When the invert door opening operation by detection of the foreign matter is repeated the predetermined number of times N or more or when the door opening standby time has reached the predetermined time T, the forcible door closing operation is started after the notification of starting the forcible door closing operation. Further, when the light emitting/receiving unit (4) detects a foreign matter during the forcible door closing operation, a notification of starting traveling of the elevator car after completion of the forcible door closing operation is made, and then traveling of the elevator car is started.

In the elevator of this embodiment, the emission of the light beam from the light emitting/receiving unit (4) is stopped when a foreign matter is detected during the door opening standby. Thus, if a person tries to place his/her head or shoulder in the entrance to look into the light beam emitted from the light emitting/receiving unit (4) during the door opening standby, the person's head or shoulder is detected as a foreign matter, and thus the emission of the light beam from the light emitting/receiving unit (4) is stopped. Thus, it is impossible to look into the light beam emitted from the light emitting/receiving unit (4) during the door opening standby, thereby preventing the light beam from being looked into during the door opening standby. Also, when a foreign matter is detected, the door opening open time is extended. Thus, when a person tries to place his/her head or shoulder in the entrance to look into the light beam immediately before the start of the door closing operation, the car doors (2) and (3) can be prevented from bumping into the person's head or shoulder.

The invert door opening operation is performed when a foreign matter is detected during the door closing operation. At this time, the emission of the light beam from the light emitting/receiving unit (4) is stopped. This can prevent the light beam from being looked into during the invert door opening operation. As in the first embodiment, when a person tries to place his/her head or shoulder in the entrance to look into the light beam emitted from the light emitting/receiving unit (4) during the door closing operation, the invert door opening operation is performed and the emission of the light beam from the light emitting/receiving unit (4) is stopped, thereby preventing the light beam from being looked into during the door closing operation.

Further, the emission of the light beam from the light emitting/receiving unit (4) is stopped during the normal door opening operation, thereby preventing the light beam from being looked into during the normal door opening operation.

Further, starting the forcible door closing operation is notified before the forcible door closing operation is started, and thus an accident can be prevented that a passenger is caught between the car door and the landing door at the completion of the forcible door closing operation. When the light emitting/receiving unit (4) still detects a foreign matter during the forcible door closing operation in spite of the fact that starting the forcible door closing operation is notified, this situation is notified after the forcible door closing operation is completed and before the traveling of the elevator car is started. Thus, an accident can be prevented that the traveling of the elevator car is started with a string-like foreign matter caught between the car door and the landing door after the forcible door closing operation is completed.

The configurations of the present invention are not limited to the embodiments described above, but various changes may be made within the technical scope of claims.

Figure 25:
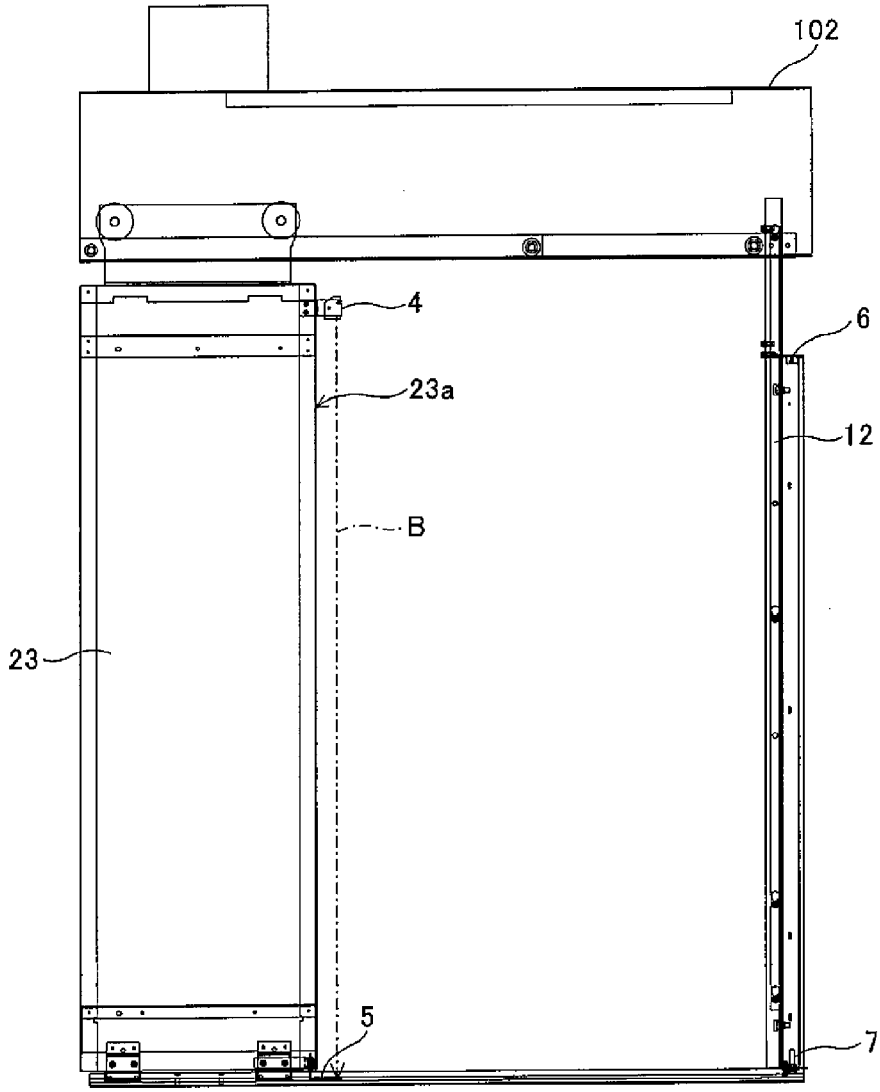
FIG. 25 is a front view showing a fully opened state of a car door of another elevator that can carry out the present invention.

For example, in the first to third embodiments, the present invention is carried out as the center open type elevator safety device. However, as shown in FIG. 25, the present invention may be carried out as a side open type elevator safety device including at least one car door (23) that moves toward and away from a doorstop frame (12) to close and open an entrance. In such an elevator safety device, for example, as shown, the car door (23) includes a light emitting/receiving unit (4) provided so as to be directed downward in an upper end position on a vertical line a predetermined distance apart from an end surface (23*a*) in a closing direction to abut against the doorstop frame (12) toward the doorstop frame (12), and a first reflecting member (5) provided so as to be directed upward in a lower end position of the line.

Figure 26:
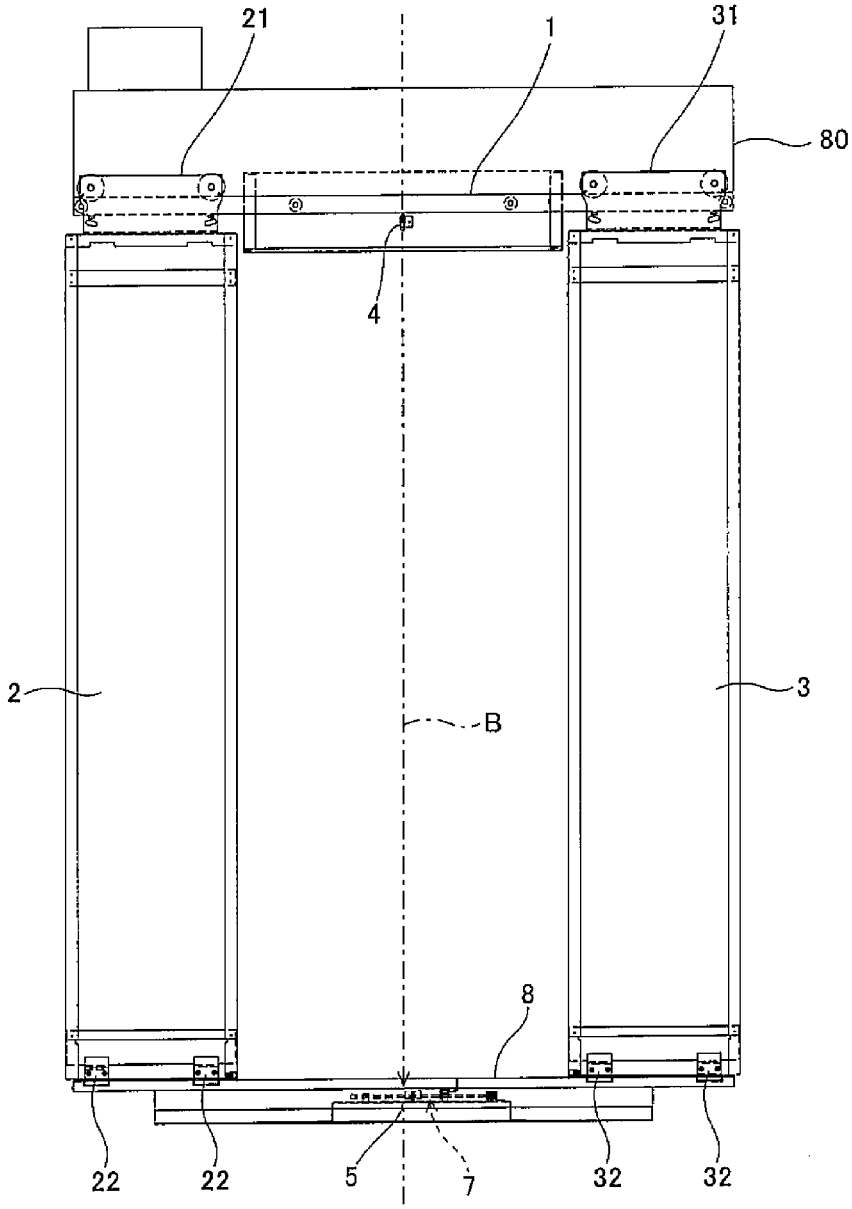
FIG. 26 is a front view showing a fully opened state of car doors of a further elevator that can carry out the present invention.

As shown in FIG. 26, the present invention may be carried out as an elevator safety device including a light emitting/receiving unit (4) provided on a frame (80) in an upper position of an entrance and a reflecting member (5) provided on a doorsill (8) in a lower position of the entrance. In such an elevator safety device, for example, as shown, the light emitting/receiving unit (4) is provided on the frame (80) so as to be directed downward and the reflecting member (5) is provided on the doorsill (8) so as to be directed upward in positions on a vertical line on an abutment position of a pair of car doors (2) and (3) in a fully closed state.

Figure 27:
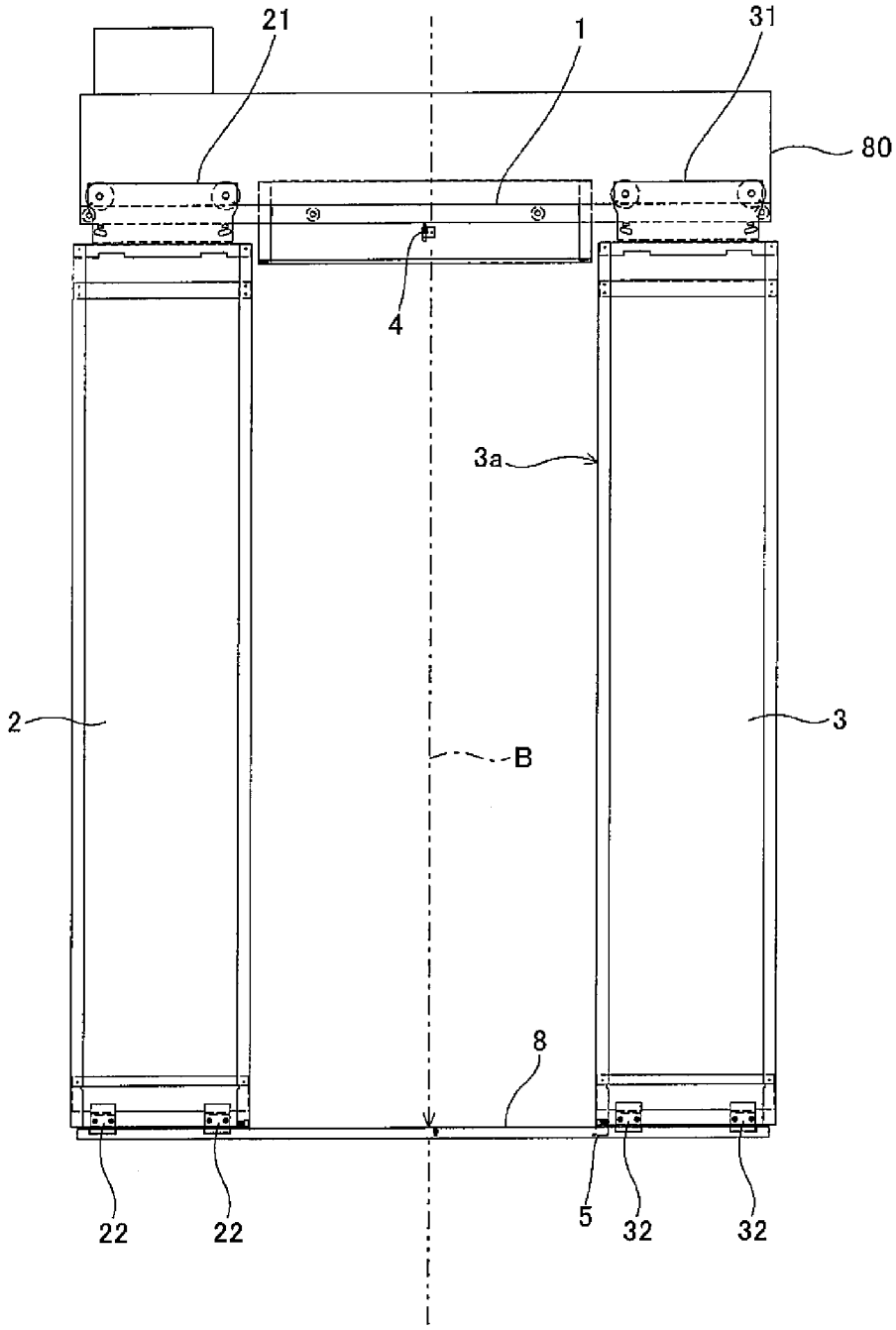
FIG. 27 is a front view showing a fully opened state of car doors of a further elevator that can carry out the present invention.

As shown in FIG. 27, the present invention may be carried out as an elevator safety device in which a light emitting/receiving unit (4) is provided on a frame (80) in an upper position of an entrance, and a reflecting member (5) is provided on one car door (3) of a pair of car doors (2) and (3). In such an elevator safety device, for example, as shown, the light emitting/receiving unit (4) is provided on the frame (80) so as to be directed downward in a position on a vertical line on an abutment position of the pair of car doors (2) and (3) in a fully closed state, and the reflecting member (5) is provided on one car door (3) so as to be directed upward in a lower end position of an end surface (3*a*) in a closing direction to abut against the other car door (2)

Figure 28:
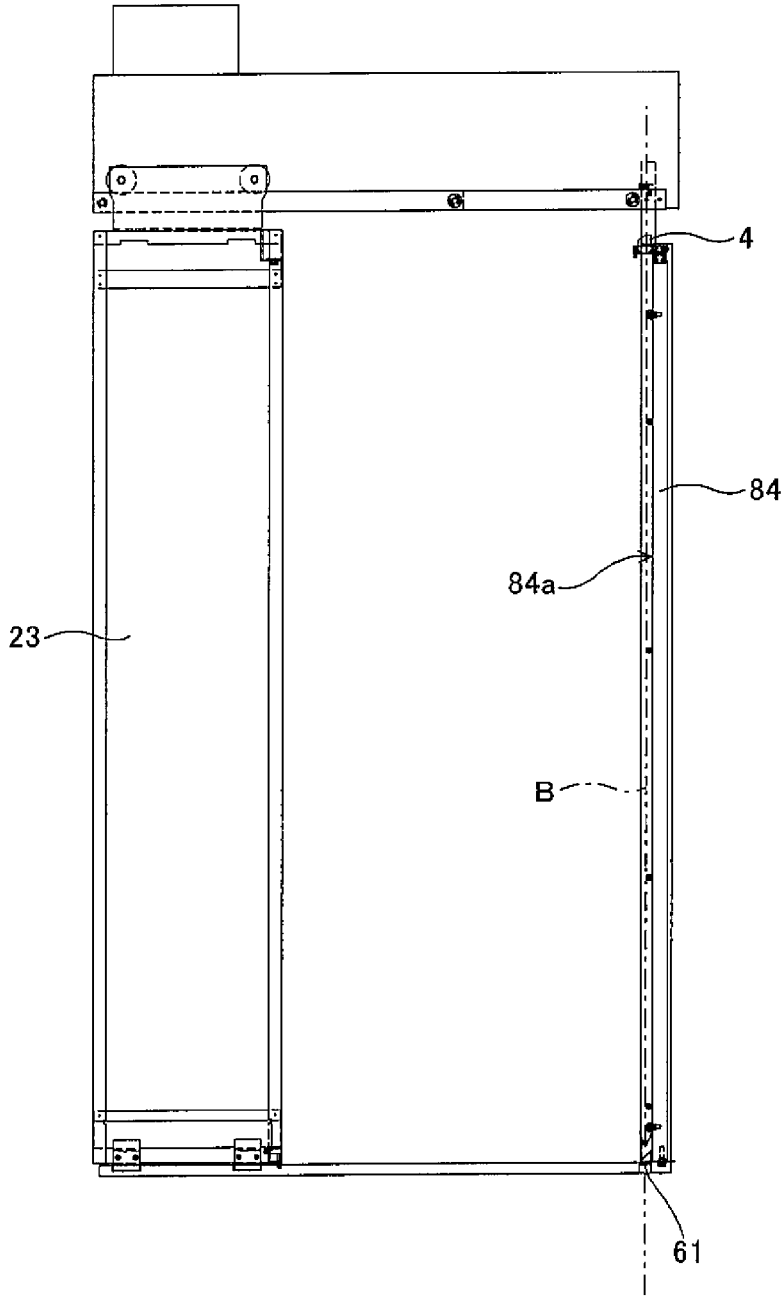
FIG. 28 is a front view showing a fully opened state of a car door of a further elevator that can carry out the present invention.
Figure 29:
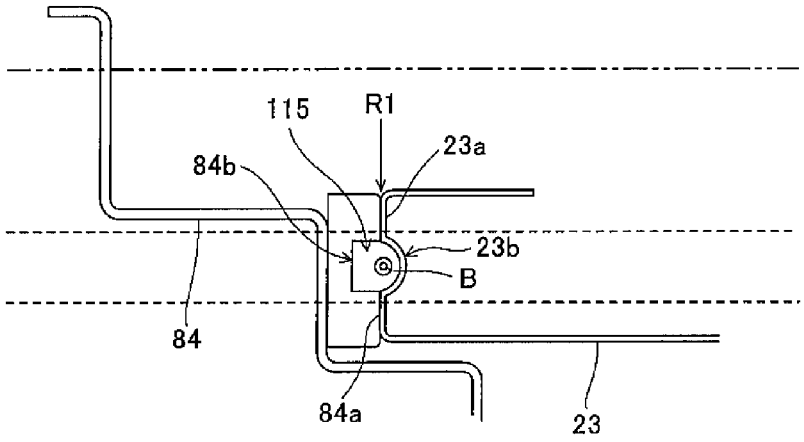
FIG. 29 is a horizontal sectional view showing essential parts of a further elevator that can carry out the present invention.
Figure 30:
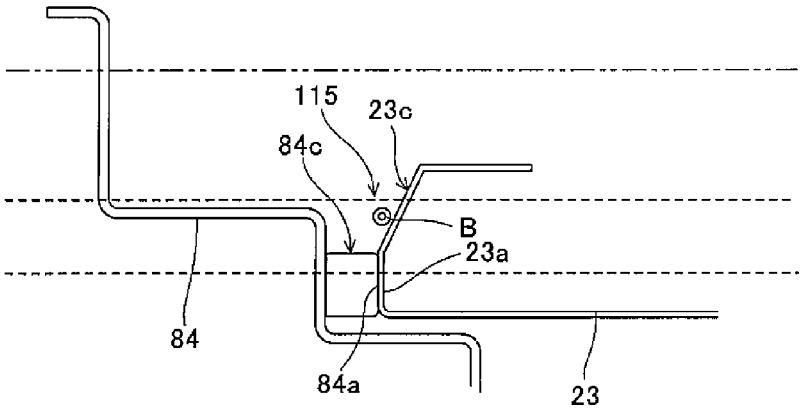
FIG. 30 is a horizontal sectional view showing essential parts of a further elevator that can carry out the present invention.

As shown in FIG. 28, the present invention may be carried out as an elevator safety device in which a light emitting/receiving unit (4) and a reflecting member (61) are provided on a doorstop frame (84). In such an elevator safety device, for example, as shown, on the doorstop frame (84), the light emitting/receiving unit (4) is provided so as to be directed downward in an upper end position on a vertical line a predetermined distance apart from an end surface (84*a*) to abut against a car door (23) toward the car door (23), while the reflecting member (61) is provided so as to be directed upward in a lower end position on the line. The light emitting/receiving unit (4) may be provided in an upper end position on a vertical line on an abutment position R1 (see FIG. 29) against which the car door (23) abuts in a fully closed state, and the reflecting member (61) may be provided in a lower position on the line. In such an elevator safety device, as shown in FIGS. 29 and 30, a pair of recesses (84*b*) and (23*b*) or a pair of notches (84*c*) and (23*c*) extending along the line are formed in the end surface (84*a*) of the doorstop frame (84) to abut against the car door (23) and an end surface (23*a*) in a closing direction of the car door (23) to abut against the doorstop frame (84), and a passage (115) through which the light beam is passed in the fully closed state of the car door (23) is formed by the pair of recesses (84*b*) and (23*b*) or the pair of notches (84*c*) and (23*c*).

In the embodiments, the present invention is carried out as the elevator safety device that detects a foreign matter using a light beam vertically crossing the entrance. However, the present invention may be carried out as an elevator safety device that detects a foreign matter using a light beam horizontally crossing the entrance.

Further, the present invention may be carried out as an elevator safety device including a multi-optical axis sensor that emits multiple light beams crossing the entire or substantially entire region of an entrance together with a light emitting/receiving unit (4), and generates a foreign matter detection signal when even a part of the light beams is interrupted. For example, in an elevator using the control procedure shown in FIGS. 18 and 19, when a person tries to look into the light beam immediately after the start of the door closing operation, a head or a shoulder is detected as a foreign matter at the moment when the head or shoulder is placed in the entrance to stop emission of the light beam, thereby reliably preventing the light beam from being looked into during the door closing operation. Also in an elevator using the control procedure shown in FIGS. 22 to 24, similarly, the light beam is reliably prevented from being looked into during door opening standby and door closing operation.

Further, the present invention may be carried out as an elevator safety device in which a light beam emitted from a light emitter directly enters a light receiver unless there is a foreign matter on a path of the light beam, like an elevator safety device in which a light emitter is provided in, for example, an upper position of an entrance, and a light receiver is provided in a lower position.

DESCRIPTION OF SYMBOLS (1) rail
(2) car door
(2*a*) end surface in closing direction
(3) car door
(3*a*) end surface in closing direction
(30) housing space
(4) light emitting/receiving unit
(5) first reflecting member
(6) second reflecting member
(7) cleaning tool
(8) doorsill
(9) foreign matter entrance preventing member
(100) control unit
B light beam
S string

The invention claimed is:

1. An elevator safety device that includes a pair of car doors that move toward and away from each other to close and open an entrance, comprising:

light emitting means for emitting a light beam crossing the entrance in a vertical direction;

light receiving means for detecting the light beam emitted from the light emitting means;

foreign matter detection means for generating a foreign matter detection signal when detection of the light beam by the light receiving means is interrupted; and control means for controlling opening and closing operations of the car doors and an emission of the light beam by the light emitting means, wherein the control means causes the light emitting means to stop the emission in a fully opened state of the car doors, and causes the light emitting means to start the emission at a start of or during the closing operation of the car doors.

2. An elevator safety device that includes a pair of car doors that move toward and away from each other to close and open an entrance, comprising:

light emitting means for emitting a light beam crossing the entrance in a vertical direction;

light receiving means for detecting the light beam emitted from the light emitting means;

foreign matter detection means for generating a foreign matter detection signal when detection of the light beam by the light receiving means is interrupted;

closed position detection means for detecting that the car doors are closed to a predetermined closed position; and control means for controlling opening and closing operations of the car doors and an emission of the light beam by the light emitting means, wherein the control means causes the light emitting means to stop the emission in a fully opened state of the car doors and after a closing operation of the car doors is started and until the closed position detection means detects that the car doors are closed to the predetermined closed position, and causes the light emitting means to start the emission when the closed position detection means detects that the car doors are closed to the predetermined closed position.

3. The elevator safety device according to claim 1, wherein the control means causes the light emitting means to stop the emission during a normal opening operation in which the car doors open from a fully closed position.

4. The elevator safety device according to claim 1, wherein the control means inverts the car doors from the closing operation to the opening operation when the foreign matter detection means generates a foreign matter detection signal during closing of the car doors, and causes the light emitting means to stop the emission during an invert opening operation of the car doors.

5. An elevator safety device that includes a pair of car doors that move toward and away from each other to close and open an entrance, comprising:

light emitting means for emitting a light beam crossing the entrance in a vertical direction;

light receiving means for detecting the light beam emitted from the light emitting means;

foreign matter detection means for generating a foreign matter detection signal when detection of the light beam by the light receiving means is interrupted; and control means for controlling opening and closing operations of the car doors and an emission of the light beam by the light emitting means, wherein the control means causes the light emitting means to perform the emission in a fully opened state of the car doors, and causes the light emitting means to stop the emission when the foreign matter detection means generates a foreign matter detection signal in the state.

6. The elevator safety device according to claim 5, wherein the control means extends a time period during which the car doors should be maintained in the fully opened state when the foreign matter detection means generates a foreign matter detection signal in the fully opened state of the car doors.

7. The elevator safety device according to claim 5, wherein the control means causes the light emitting means to stop the emission in the fully opened state of the car doors, then causes the light emitting means to start the emission at the expiration of the time period during which the car doors should be maintained in the fully opened state, and causes the light emitting means to stop the emission and extends the time period during which the car doors should be maintained in the fully opened state when the foreign matter detection means generates a foreign matter detection signal, while the control means starts the closing operation of the car doors when no foreign matter detection signal is generated.

8. The elevator safety device according to claim 5, wherein the control means causes the light emitting means to stop the emission during a normal opening operation in which the car doors open from the fully closed position.

9. The elevator safety device according to claim 5, wherein the control means causes the light emitting means to perform the emission during the closing operation of the car doors, inverts the car doors from the closing operation to the opening operation when the foreign matter detection means generates a foreign matter detection signal during closing of the car doors, and causes the light emitting means to stop the emission during an invert opening operation of the car doors.

10. The elevator safety device according to claim 1, wherein the control means includes:

forcible door closing means for performing a forcible door closing operation of forcibly closing the car doors irrespective of whether or not the foreign matter detection means generates a foreign matter detection signal; and notification means for notifying of performance of the forcible door closing operation before or during the forcible door closing operation by the forcible door closing means.

11. The elevator safety device according to claim 10, wherein the control means includes: the control means further includes:

elevator car control means for starting traveling of the elevator car after the forcible door closing means completes the forcible door closing operation; and second notification means for notifying of starting traveling of the elevator car before the elevator car control means starts traveling of the elevator car when the foreign matter detection means generates a foreign matter detection signal during the forcible door closing operation by the forcible door closing means.

12. An elevator safety device that includes at least one car door that moves toward and away from a doorstop frame to close and open an entrance, comprising:

light emitting means for emitting a light beam crossing the entrance in a vertical direction;

light receiving means for detecting the light beam emitted from the light emitting means;

foreign matter detection means for generating a foreign matter detection signal when detection of the light beam by the light receiving means is interrupted; and control means for controlling opening and closing operations of the car door and an emission of the light beam by the light emitting means, wherein the control means causes the light emitting means to stop the emission in a fully opened state of the car door, and causes the light emitting means to start the emission at a start or during the closing operation of the car door.

13. An elevator safety device that includes at least one car door that moves toward and away from a doorstop frame to close and open an entrance, comprising:

light emitting means for emitting a light beam crossing the entrance in a vertical direction;

light receiving means for detecting the light beam emitted from the light emitting means;

foreign matter detection means for generating a foreign matter detection signal when detection of the light beam by the light receiving means is interrupted;

closed position detection means for detecting that the car door is closed to a predetermined closed position; and control means for controlling opening and closing operations of the car door and an emission of the light beam by the light emitting means, wherein the control means causes the light emitting means to stop an emission in a fully opened state of the car door and after the closing operation of the car door is started and until the closed position detection means detects that the car door is closed to the predetermined closed position, and causes the light emitting means to start the emission when the closed position detection means detects that the car door is closed to the predetermined closed position.

14. The elevator safety device according to claim 12, wherein the control means causes the light emitting means to stop the emission during a normal opening operation in which the car door opens from the fully closed position.

15. The elevator safety device according to claim 12, wherein the control means inverts the car door from the closing operation to the opening operation when the foreign matter detection means generates a foreign matter detection signal during closing of the car door, and causes the light emitting means to stop the emission during the invert opening operation of the car door.

16. An elevator safety device that includes at least one car door that moves toward and away from a doorstop frame to close and open an entrance, comprising:

light emitting means for emitting a light beam crossing the entrance in a vertical direction;

light receiving means for detecting the light beam emitted from the light emitting means;

foreign matter detection means for generating a foreign matter detection signal when detection of the light beam by the light receiving means is interrupted; and control means for controlling opening and closing operations of the car door and an emission of the light beam by the light emitting means, wherein the control means causes the light emitting means to perform the emission in a fully opened state of the car door, and causes the light emitting means to stop the emission when the foreign matter detection means generates a foreign matter detection signal in the state.

17. The elevator safety device according to claim 16, wherein the control means extends a time period during which the car door should be maintained in the fully opened state when the foreign matter detection means generates a foreign matter detection signal in the fully opened state of the car door.

18. The elevator safety device according to claim 16, wherein the control means causes the light emitting means to stop the emission in the fully opened state of the car door, then causes the light emitting means to start the emission at the expiration of the time period during which the car door should be maintained in the fully opened state, and causes the light emitting means to stop the emission and extends the time period during which the car door should be maintained in the fully opened state when the foreign matter detection means generates a foreign matter detection signal, while the control means starts the closing operation of the car door when no foreign matter detection signal is generated.

19. The elevator safety device according to claim 16, wherein the control means causes the light emitting means to stop the emission during a normal opening operation in which the car door opens from the fully closed position.

20. The elevator safety device according to claim 16, wherein the control means causes the light emitting means to perform the emission during the closing operation of the car door, inverts the car door from the closing operation to the opening operation when the foreign matter detection means generates a foreign matter detection signal during closing of the car door, and causes the light emitting means to stop the emission during an invert opening operation of the car door.

21. The elevator safety device according to claim 12, wherein the control means further includes:

forcible door closing means for performing a forcible door closing operation of forcibly closing the car door irrespective of whether or not the foreign matter detection means generates a foreign matter detection signal; and notification means for notifying of performance of the forcible door closing operation before or during the forcible door closing operation by the forcible door closing means.

22. The elevator safety device according to claim 21, wherein the control means further includes:

elevator car control means for starting traveling of the elevator car after the forcible door closing means completes the forcible door closing operation; and second notification means for notifying of starting traveling of the elevator car before the elevator car control means starts traveling of the elevator car when the foreign matter detection means generates a foreign matter detection signal during the forcible door closing operation by the forcible door closing means.

* * * * *